US006357496B1

(12) United States Patent
Koike

(10) Patent No.: US 6,357,496 B1
(45) Date of Patent: Mar. 19, 2002

(54) VENEER LATHE

(75) Inventor: Masaru Koike, Aichi (JP)

(73) Assignee: Meinan Machinery Works, Inc., Obu (JP)

( * ) Notice: Subject to any disclaimer, the term of this patent is extended or adjusted under 35 U.S.C. 154(b) by 0 days.

(21) Appl. No.: 09/635,665

(22) Filed: Aug. 10, 2000

(30) Foreign Application Priority Data

Aug. 12, 1999 (JP) ..... 11-228853
May 25, 2000 (JP) ..... 2000-159557

(51) Int. Cl.[7] ..... B27L 5/02
(52) U.S. Cl. ..... 144/213; 144/209.1; 144/365
(58) Field of Search ..... 144/209.1, 211, 144/213, 213 A, 362, 365

(56) References Cited

U.S. PATENT DOCUMENTS 4,219,060 A * 8/1980 Hasegawa ..... 144/213 R
4,221,247 A * 9/1980 Katsuji ..... 144/213

FOREIGN PATENT DOCUMENTS

JP 1-24602 5/1989

* cited by examiner

*Primary Examiner*—W Donald Bray
(74) *Attorney, Agent, or Firm*—Armstrong, Westerman & Hattori, LLP

(57) ABSTRACT

A veneer lathe comprising a piercing roller and a guiding member for producing a veneer which is free from piercing scars. A third rotational shaft (25) is raised from the position where the piercing projections (27*a*) of the piercing rolls (27) are pierced into the outer peripheral wall of the log (3) to a position which enables the distance between the tip end of the piercing projections (27*a*) and the backing plate (5*a*), the concave portion (4) and the guide member (6) to become larger than the thickness of the veneer (T1), and then, the third rotational shaft (25) is moved away from the log (3) up to a position which makes the piercing projections (27*a*) impossible to pierce the outer peripheral wall of the log (3), after which the log (3) is rotated to perform the cutting by means of knife (5).

8 Claims, 15 Drawing Sheets

VENEER LATHE

BACKGROUND OF THE INVENTION

The present invention relates to a veneer lathe (peeling machine) for cutting (peeling) a veneer by making use of a cutting knife from a rotating log.

As disclosed in U.S. Pat. No. 4,219,060; U.S. Pat. No. 4,221,247; and Japanese Patent S59-45484, there is known a veneer lathe comprising a roller disposed substantially parallel with the linear cutting edge of the knife and provided with a large number of driving members which are arranged at intervals along the axial direction of the roller, each driving member being provided along the circumference thereof with a large number of piercing projections, and a guiding member for guiding a veneer that has been cut by the knife to run along the driving members.

The aforementioned conventional veneer lathe is constructed as shown in FIG. 13 illustrating a partial enlarged view thereof and also in FIG. 14 illustrating a partial cross-sectional view as it is viewed in the direction of the arrow from the dot and dash line K—K in FIG. 13. By the way, a veneer 111 to be explained hereinafter is omitted in FIG. 14.

Referring to FIGS. 13 and 14, the veneer lathe comprises a cutting knife 103, and a roller disposed substantially parallel with the linear cutting edge of the knife 103 and provided with a large number of piercing rolls 105 each functioning as a driving member which are arranged, through the interposition of a ring-shaped spacer 106, at intervals along the axial direction of a rotary shaft 107 to be rotationally driven by a driving source (not shown), each piercing roller 105 being provided along the circumference thereof with a large number of piercing projections 105*a*, and both knife 103 and roller being mounted on a knife carriage 101. This roller is positioned so as to enable the piercing projections 105*a* to pierce not only the outer peripheral wall portion of a log 109 in the vicinity of the cutting edge of the knife 103 but also a portion of the veneer 111 which is located immediately after the cutting thereof during the cutting operation of the log 109.

In the space between neighboring piercing rolls 105, there is disposed a nose bar 113, upper end portion of which is fixed to a portion of the knife carriage 101 and the lower end of which is designed to be press-contacted with an outer peripheral wall portion of the log 109 which is located immediately before being cut by the cutting knife 103.

In conformity with each nose bar 113, a stripping member 115 having a stripping face 115*a* for separating the veneer 111 from the piercing projections 105*a* of piercing rolls 105 is attached to the knife carriage 101. Furthermore, a concaved member 101*a* and a guiding member, both of which are designed to guide the veneer 111 that has been cut by the cutting knife 103 to run along the piercing rolls 105, are attached to the knife carriage 101.

In this case, as explained hereinafter, the veneer 111 is completely press-contacted with the stripping face 115*a* of stripping member 115 so as to form slits 111*a* on front surface of the veneer 111, or the surface facing the stripping face 115*a*, and furthermore, for the purpose of enhancing the effect of flattening the veneer, the distance between the tip end of the piercing projections 105*a* and the concaved member 101*a* or the guiding member 117 is usually made smaller than the thickness of the veneer 111.

By making use of the veneer lathe having the aforementioned structure, the piercing rolls 105 is allowed to rotate and at the same time, the log 109 is allowed to rotate by means of a spindle (not shown) while controlling a synchronizing mechanism (not shown) in such a manner that the peripheral speed of the log 109 becomes always identical with the peripheral speed of the piercing rolls 105, under which conditions, the knife carriage 1 is moved at ratio of 3.5 mm per rotation of the log 109.

As a result, as shown in FIG. 13, the outer peripheral wall of the log 109 is permitted to be pierced by the piercing projections 105*a* of the piercing rolls 105 as shown in FIG. 13, thereby giving a rotational force to the log 109 also from the piercing rolls 105 and allowing the log 109 to be cut by the knife 103 with the peripheral surface of the log 109 being pressed by the chip 113*a* of nose bar 113, thus obtaining the veneer 111 having a thickness of 3.5 mm for instance.

In this case, the veneer 111 is pierced by the piercing projections 105*a* and allowed to move as guided by the concaved member 101*a* and the guiding member 117 to the stripping member 115, which enables the veneer 111 to be separated from the piercing projections 105*a* and bent to form slits 111*a* in the veneer 111. As a result, it is possible to obviate the generation of so-called curling phenomenon or a phenomenon of causing the veneer to be rounded into a cylindrical configuration, thus making it possible to obtain a flat veneer, which makes it easy to work the veneer in the following steps.

As explained above, the provision of these concaved member 101*a*, guiding member 117 and stripping member 115 is certainly important in the aforementioned veneer lathe. However, due to the piercing by the piercing projections 105*a* of piercing rolls 105, a large number of scars are caused to be formed on the front surface of the veneer 111.

As in a case where a face sheet to be employed as a front sheet of plywood for example is to be produced in the aforementioned veneer lathe, it is sometimes desired to obtain a veneer 111 having a flat front surface which is free from any pierced scar due to the piercing projections 105*a* of piercing rolls 105. According to the conventional veneer lathe however, even if the rotational axis 107 of the piercing rolls 105 is moved away from the log 109 from the state shown in FIG. 13, i.e. moved in the rightward direction in FIG. 13, thus separating the piercing projections 105*a* from the log 109 as shown in FIG. 15, it is impossible, due to fact that the concaved member 101*a* constituting a guide member and the guiding member 117 are located along the transferring direction of veneer, to avoid the pierced scar by the piercing rolls 105 from being formed in the front surface of the veneer 111.

Namely, in the state shown in FIG. 15, the log 109 can be prevented from being pierced by the piercing projections 105*a*. However, since the distance between the tip end of the piercing projections 105*a* of the piercing rolls 105 and the concaved member 101*a* or the guiding member 117 cannot be changed substantially, the veneer 111 is caused to be pierced by the piercing projections 105*a* as it passes through the concaved member 101*a* or the guiding member 117, thereby leaving pierced scars on the surface of the veneer 111.

BRIEF SUMMARY OF THE INVENTION

The object of the present invention is to provide a veneer lathe which is capable of producing a veneer which is free from the aforementioned pierced scars in spite of facts that the veneer lathe is provided with a driving member such as the aforementioned piercing rolls 105 and with a guiding member such as the concaved member 101*a* or the guiding member 117.

Namely, the veneer lathe according to the present invention comprises; a knife for cutting a log; a roller disposed substantially parallel with the linear cutting edge of the knife and provided with a large number of driving members which are arranged at intervals along the axial direction of the roller, each driving member being provided along the circumference thereof with a large number of piercing projections; a driving mechanism attached to the roller; a pressure member disposed at a location which enables the pressure member to press-contact with the outer peripheral wall of the log through a plurality of spaces formed between said driving members neighboring to each other of the roller; a guiding member for guiding a veneer which is cut by means of said knife to move along said driving members; a knife carriage for mounting thereon said knife, said roller, said driving mechanism, said pressure member and said guiding member; a spindle rotatably supporting a log; and a driving for rotating said spindle; wherein said roller is enabled to take a first position wherein said piercing projections of the driving member is enabled to pierce not only the outer peripheral wall portion of a log in the vicinity of said cutting edge of said knife but also a portion of the veneer which is cut by said cutting knife and is not yet passed through said guiding member, as well as to take a second position wherein said piercing projections of the driving member is not allowed to contact with not only the outer peripheral wall portion of the log but also said portion of the veneer or wherein the tip ends of said piercing projections are contacted only with the outer peripheral wall portion of the log in the vicinity of said cutting edge, said rollers being designed to be fixed at said first position or at said second position.

According to the veneer lathe of the present invention, the roller is kept at the first position on the occasion of ordinary cutting operation. However, when it is desired to obtain a veneer having a flat smooth surface as in the case where a face sheet to be employed as a front sheet of plywood is desired to obtain, the roller is moved from the first position to the second position. As a result, it becomes possible to avoid the veneer to be cut from being pierced by the piercing projections, thus obtaining a veneer free from any piercing scar.

Although there is not any particular limitation regarding the means for moving the roller from the first position to the second position and vice versa, and for fixing the roller at these positions, the means should preferably be constituted by a first reciprocating member mounted on the knife carriage for enabling the roller to be reciprocatively moved to take a position permitting the piercing projections to pierce the outer periphery of log in the vicinity of the cutting edge of the knife or to take a position where the piercing projections are kept away from the outer periphery of log, and by a second reciprocating member mounted on the knife carriage for enabling the roller to be reciprocatively moved to take a position where a distance between the tip end of the piercing projections and the guiding member located in the vicinity of the cutting edge of the knife and in the running direction of the log is smaller than the thickness of the veneer being cut, and to take a position where said distance is larger than the thickness of the veneer being cut.

As for the first reciprocating member, it may be constituted by a reciprocating member which enables the roller to be reciprocatively moved to take a position permitting the piercing projections to pierce the outer periphery of log in the vicinity of the cutting edge of the knife or to take a position where the tip ends of piercing projections are allowed to contact with the outer periphery of log in the vicinity of the cutting edge.

In this veneer lathe, the first reciprocating member may be constituted by an air cylinder. Further, the second reciprocating member may be constituted by an eccentric cam, wherein the roller is rotatably secured to a lower end portion of an arm which is enabled to be moved to take, through the rotation of this eccentric cam, a position which is close to the guiding member or a position which is away from the guiding member.

Alternatively, the first reciprocating member may be constituted by a reciprocating member which enables the roller to be reciprocatively moved to take a position permitting the piercing projections to pierce the outer periphery of log in the vicinity of the cutting edge of the knife, to take a position where the tip ends of piercing projections are allowed to contact with the outer periphery of log in the vicinity of the cutting edge, or to take a position where the piercing projections are kept away from the outer periphery of log.

In this veneer lathe, the first reciprocating member may be constituted by an air cylinder provided with an intermediate stopping mechanism.

DETAILED DESCRIPTION OF THE INVENTION

The present invention will be further explained with reference various embodiments.

Figure 1:
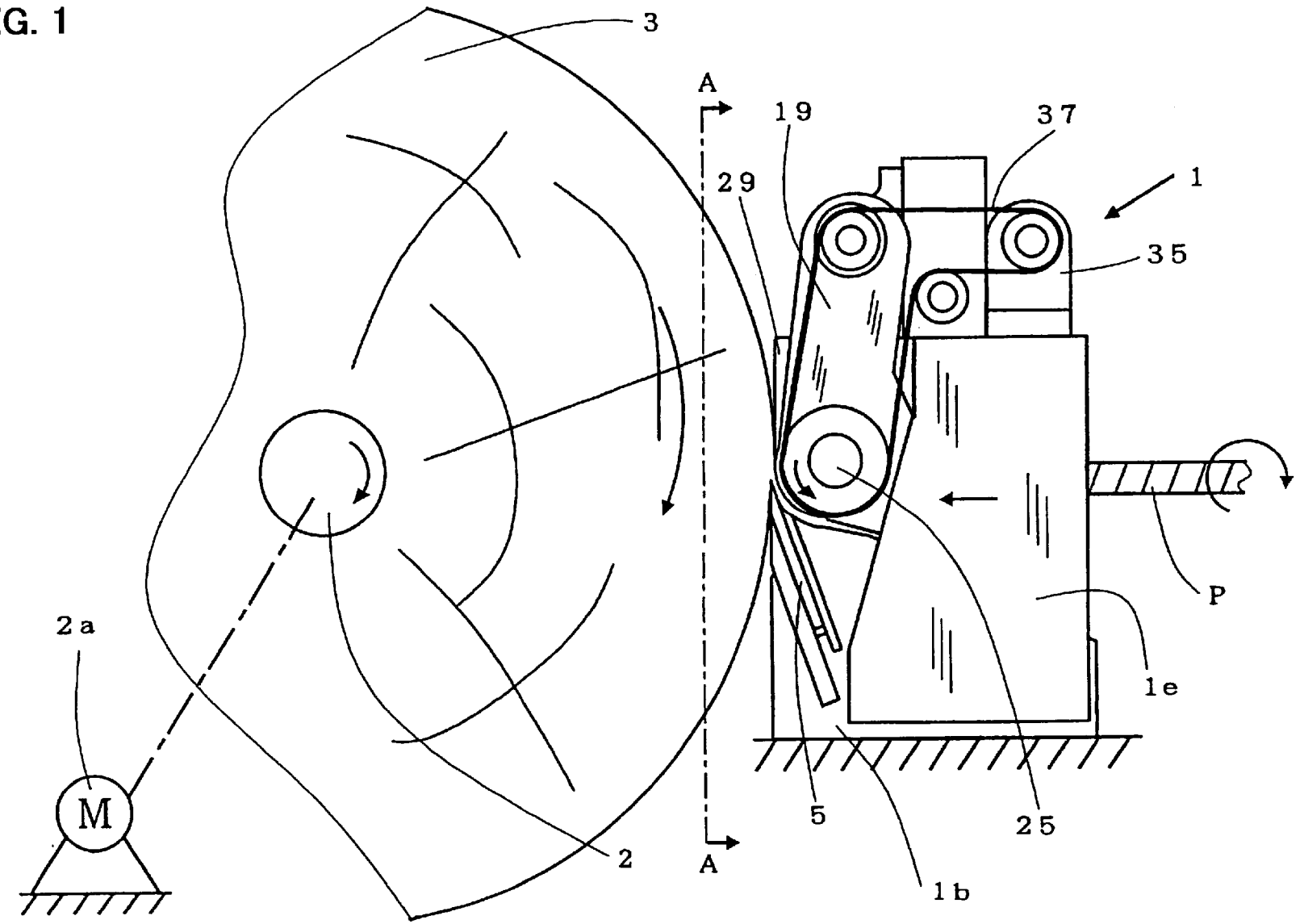
FIG. 1 is a side view schematically showing one example of a veneer lathe according to the present invention.
Figure 2:
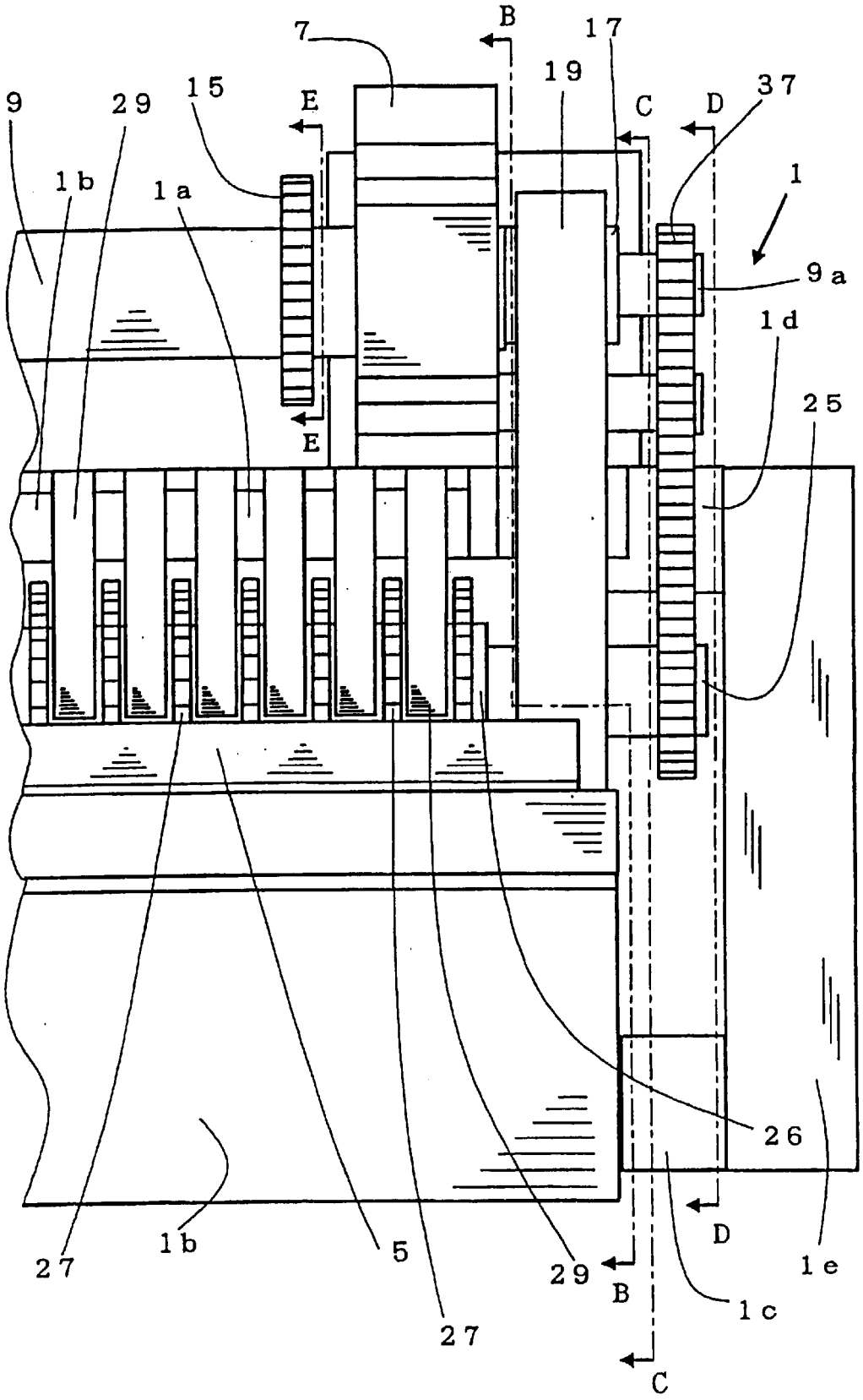
FIG. 2 is a partial front view of the right side of the knife carriage 1 which is viewed from the direction of arrows of the dot and dash line A—A of FIG. 1 wherein a log 3 is omitted.
Figure 3:
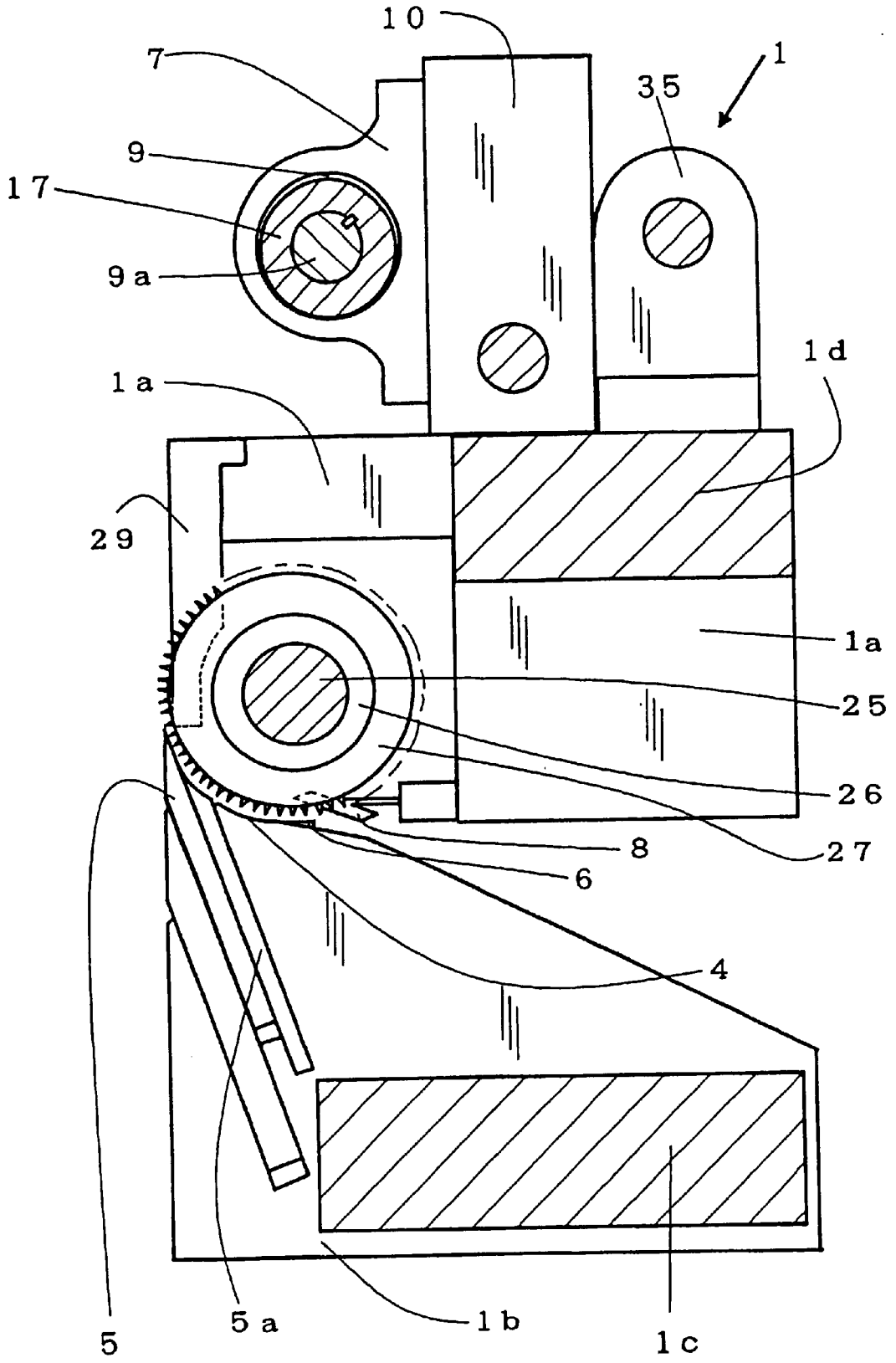
FIG. 3 is a partial cross-sectional view as it is viewed from the direction of arrows of the dot and dash line B—B of FIG. 2.
Figure 4:
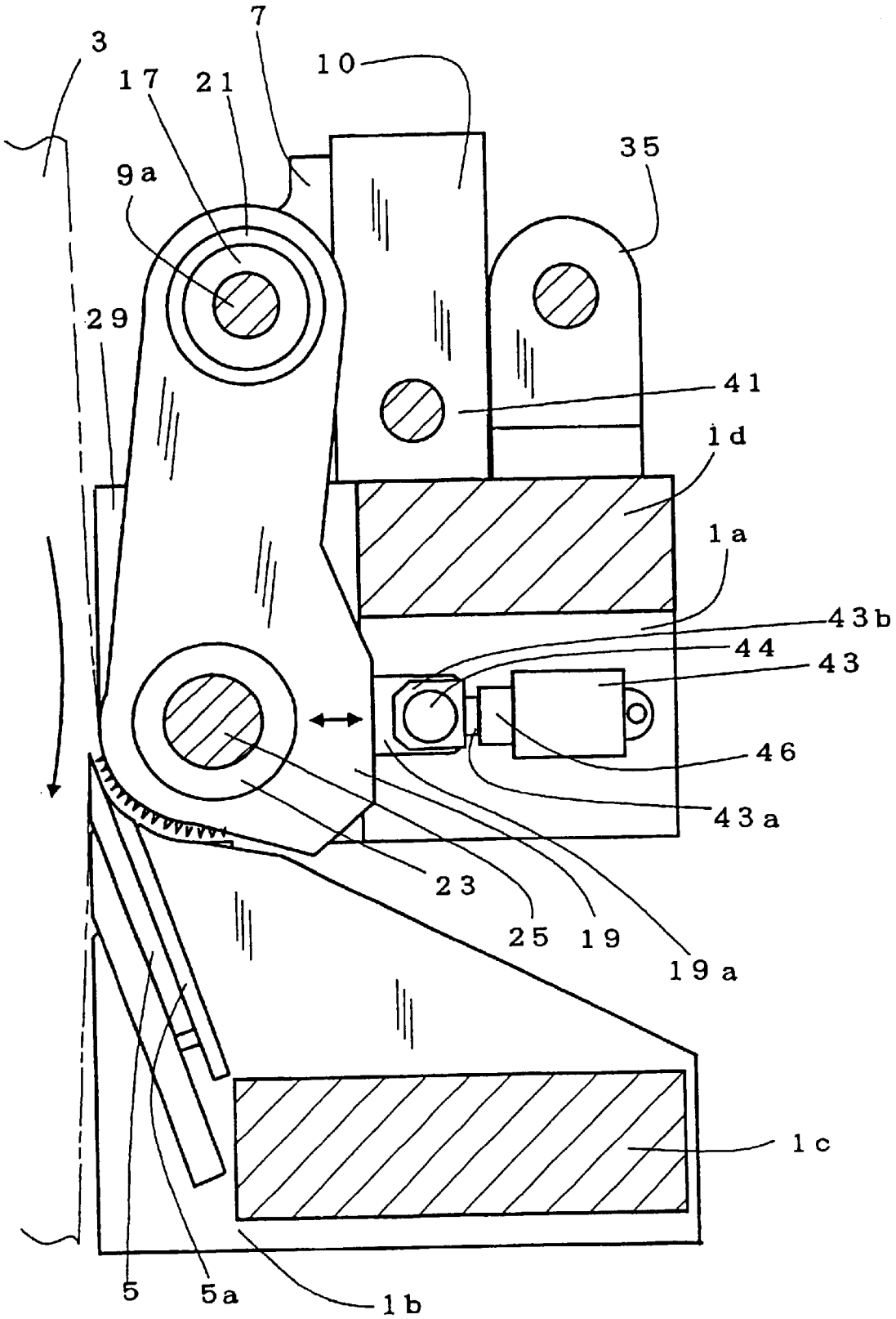
FIG. 4 is a partial cross-sectional view as it is viewed from the direction of arrows of the dot and dash line C—C of FIG. 2.
Figure 5:
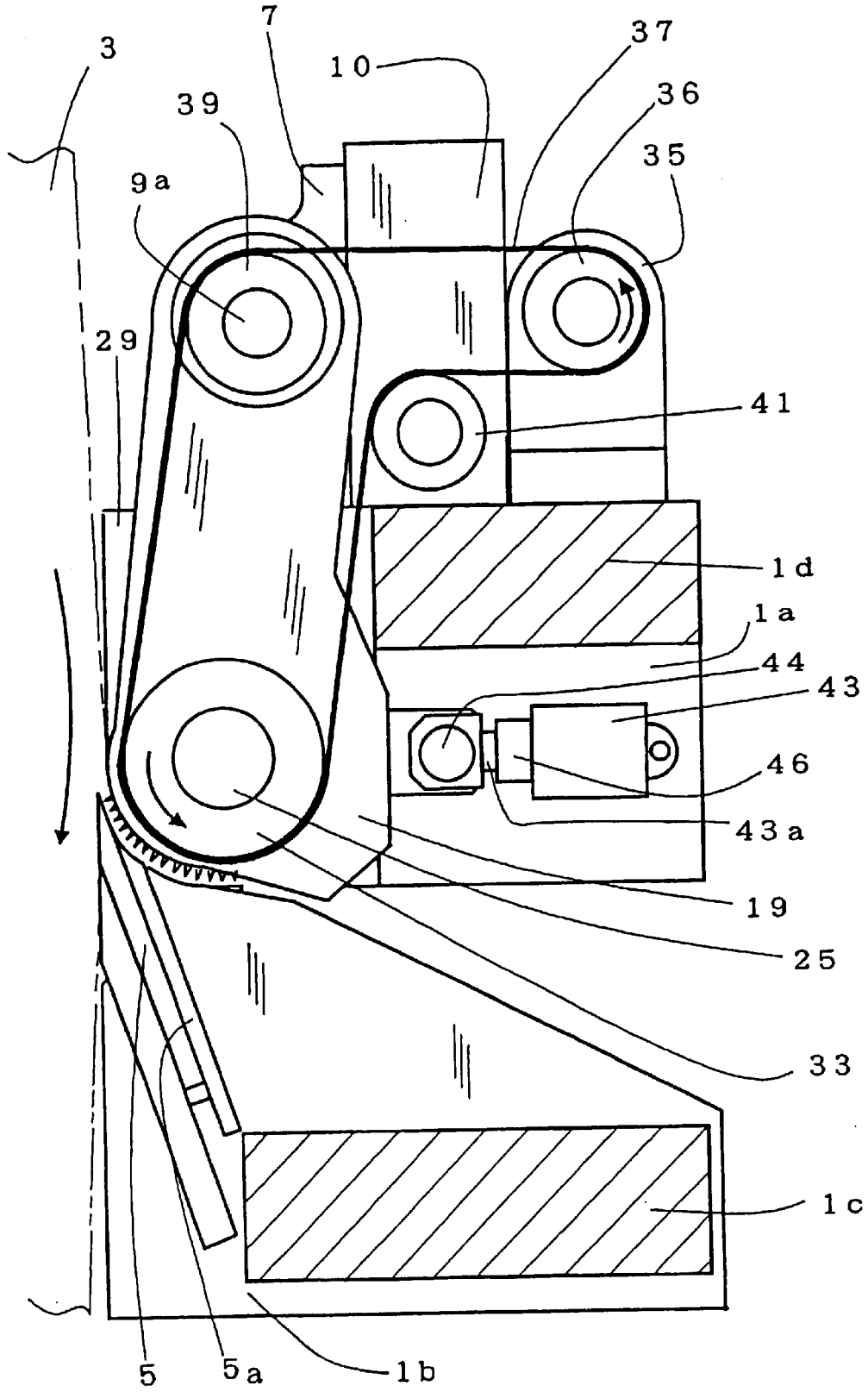
FIG. 5 is a partial cross-sectional view as it is viewed from the direction of arrows of the dot and dash line D—D of FIG. 2.
Figure 6:
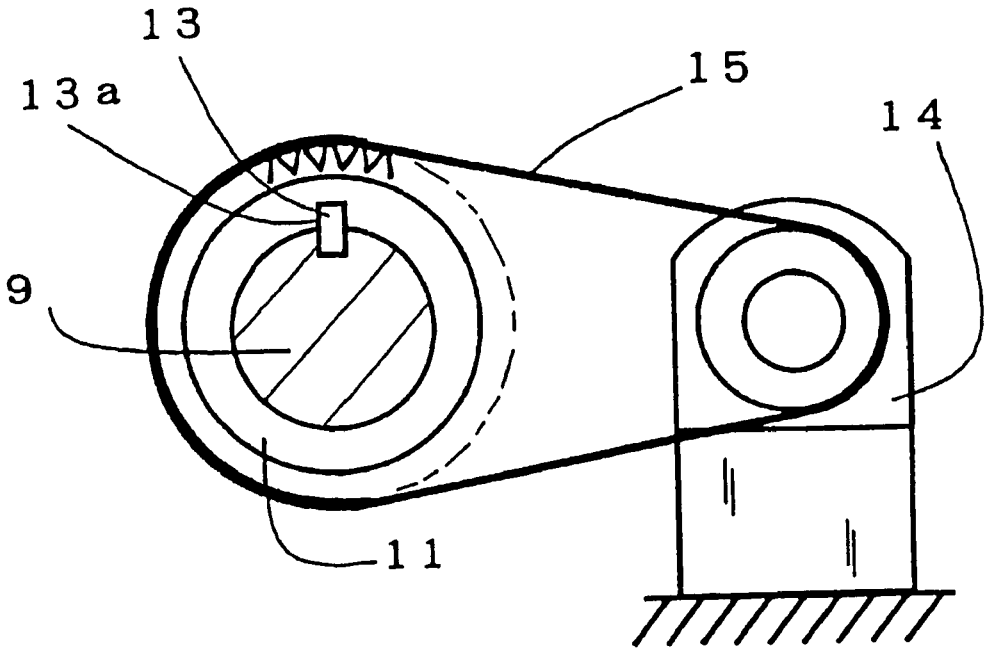
FIG. 6 is a partial cross-sectional view as it is viewed from the direction of arrows of the dot and dash line E—E of FIG. 2.

FIG. 1 shows a side view schematically illustrating the knife carriage 1 and spindle 2 of a veneer lathe; FIG. 2 shows a partial front view of the right side of the knife carriage 1 which is viewed from the direction of arrows of the dot and dash line A—A of FIG. 1 wherein a log 3 of FIG. 1 is omitted for the convenience of explanation; FIG. 3 shows a partial cross-sectional view as it is viewed from the direction of arrows of the dot and dash line B—B of FIG. 2; FIG. 4 shows a partial cross-sectional view as it is viewed from the direction of arrows of the dot and dash line C—C of FIG. 2; FIG. 5 shows a partial cross-sectional view as it is viewed from the direction of arrows of the dot and dash line D—D of FIG. 2; and FIG. 6 shows a partial cross-sectional view as it is viewed from the direction of arrows of the dot and dash line E—E of FIG. 2.

In the same manner as in the case of the conventional veneer lathe, a veneer lathe 1 is designed to be moved at a speed which enables to obtain a predetermined thickness of veneer that can be produced through the cutting by a knife 5 as explained hereinafter. For this purpose, a male screw P to be rotated by means of a motor (not shown) is engaged with a female screw (not shown) attached to the knife carriage 1, thereby enabling the veneer lathe 1 to horizontally move toward a log 3 at a distance equal to the thickness of veneer per revolution of the log 3 which is supported by the spindle 2 to be rotated in the direction of the arrow by means of a motor 2*a*.

This veneer lathe 1 is provided with various constituent components as explained below.

Namely, a pillow bearing 7 shown in FIGS. 2 and 3 is fixedly attached to the upper mount 10 of a nose bar table 1*a*, and a first rotational axis 9 is rotatably sustained by the pillow bearing 7.

As shown in FIG. 6, a sprocket 11 is fixed to the first rotational axis 9 by means of a key 13 and a key seat 13*a*, both of which are known in structure. In this case, the rotation of a servo-motor 14 provided with a tacho-generator (not shown) for detecting the quantity of rotation is transmitted to the sprocket 11, thereby permitting the first rotational axis 9 to rotate up to any desired angle within the range of from 0 to 180 degrees.

Further, the first rotational axis 9 is coaxially provided at one end thereof with a small diametral portion 9*a*, on which a cylindrical second rotational axis 17 is fixed by means of a key and a key seat (both not shown) under the condition as explained below. Namely, the outer diameter of the second rotational axis 17 is smaller than that of the first rotational axis 9 by 1 mm for instance, and the second rotational axis 17 is eccentrically attached to the small diametral portion 9*a*, so that when the through-hole thereof having an inner diameter which is equal to the outer diameter of the small diametral portion 9*a* is secured to the small diametral portion 9*a*, the outer periphery of the second rotational axis 17 is contacted at only one point with the outer periphery of the first rotational axis 9. As a result, when the first rotational axis 9 is rotated, the level of the uppermost portion of the outer periphery of the second rotational axis 17 can be altered in the elevational direction of FIGS. 2 and 3 by 2 mm at maximum for instance.

Figure 14:
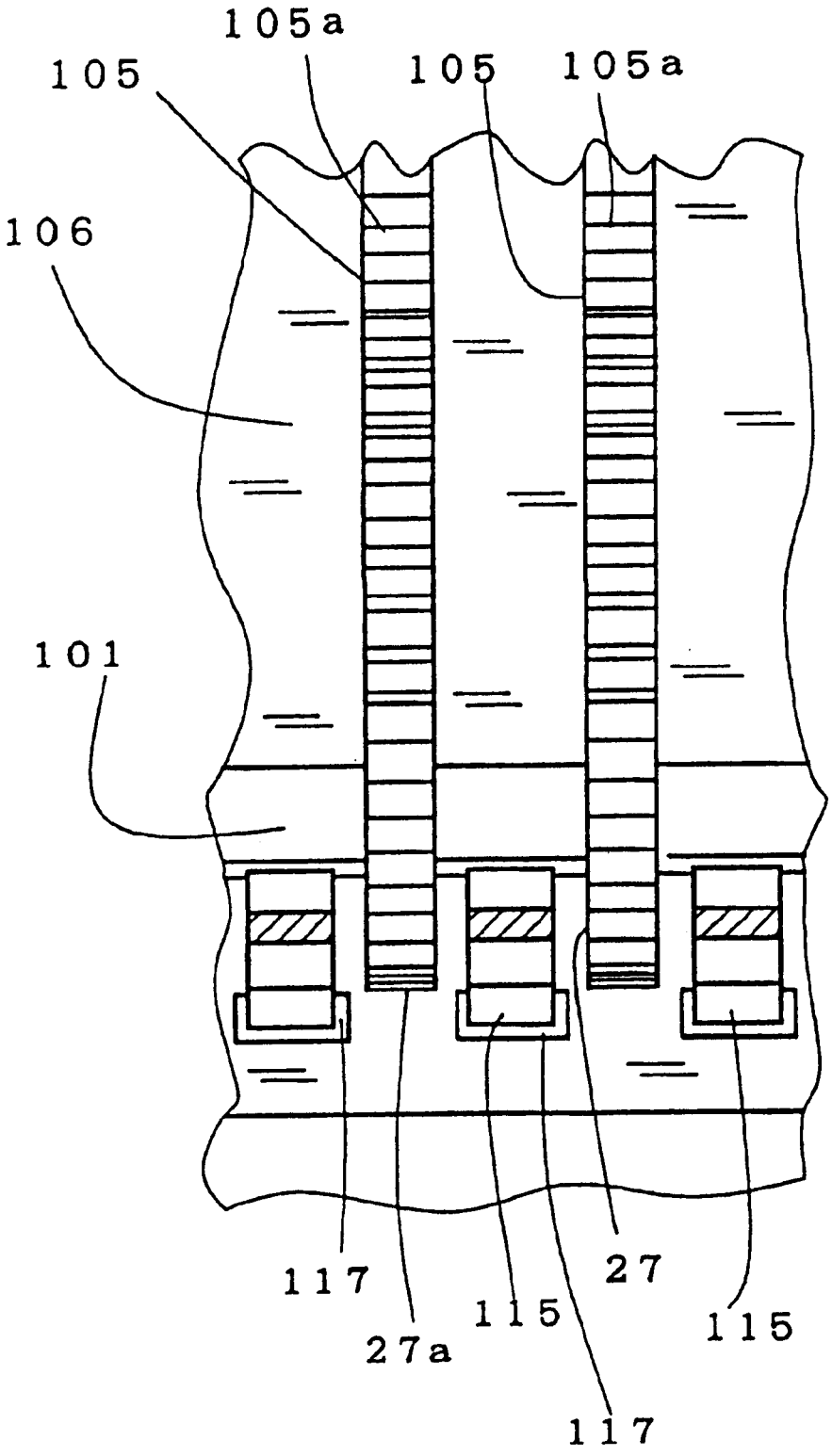
FIG.14 PRIOR ART
FIG. 14 is a partial cross-sectional view as it is viewed from the direction of arrows of the dot and dash line K—K of FIG. 11.
Figure 15:
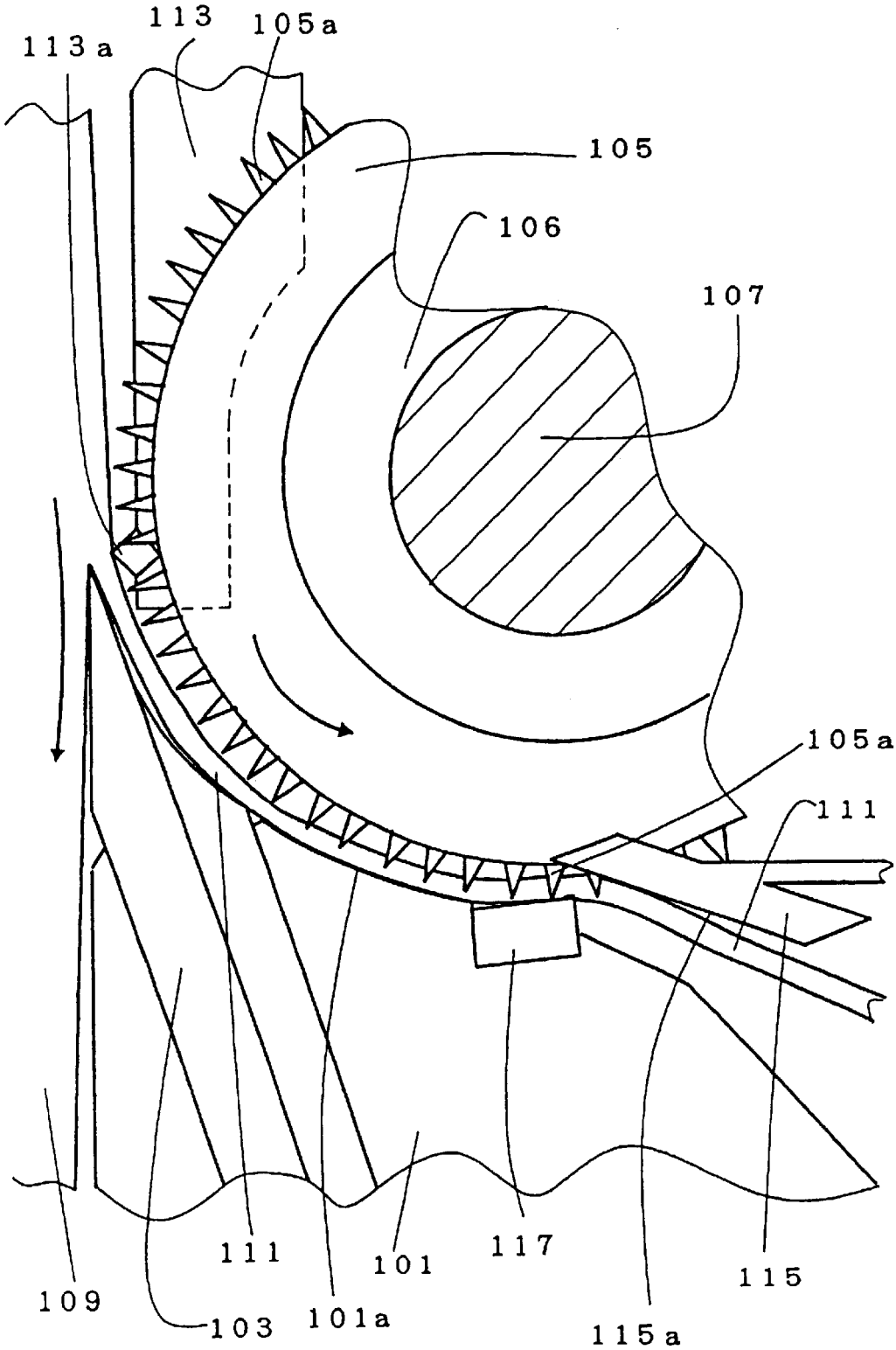
FIG.15 PRIOR ART
FIG. 15 is an enlarged side view illustrating a conventional apparatus.

As shown in FIG. 14, an upper end portion of arm 19 is sustained through a first bearing 21 to the second rotational axis 17, so that the arm 19 is permitted to rotate in relative to the second rotational axis 17.

On the other hand, an lower end portion of arm 19 is rotatably sustained through a second bearing 23 to the third rotational axis 25.

A fourth rotational axis 26 having a larger outer diameter than the outer diameter of the third rotational axis 25 is formed coaxially and integral with the third rotational axis 25, and as shown in FIGS. 2 and 3, a large number of disc-like piercing rolls 27 each having along the outer peripheral wall thereof a large number of piercing projections 27*a* and representing one example of a driving member are mounted at predetermined intervals along the longitudinal direction and coaxially on the fourth rotational axis 26 by means of a key and a key seat (both not shown), thus constructing one embodiment of the roller.

Since the roller is constructed in this manner, when the first rotational axis 9 is rotated by means of the servo-motor 14 so as to render the level of uppermost portion of the outer periphery of the second rotational axis 17 to take the lowest state, i.e. a state shown in FIG. 3, the piercing rolls 27 are kept on standby at the lowest level. On the other hand, when the first rotational axis 9 is rotated 180 degrees further from the state shown in FIG. 3 by means of the servo-motor 14 so as to render the level of uppermost portion of the outer periphery of the second rotational axis 17 to take the highest state, the piercing rolls 27 are kept on standby at the highest level.

Between each pair of the piercing rolls 27 neighboring to each other in the axial direction of the fourth rotational axis 26, there is interposed, as shown in FIG. 3, a nose bar 29 representing one example of the pressure member with the upper end portion of the nose bar 29 being fixed to the nose bar table 1*a*. By the way, as explained hereinafter, the nose bar 29 is detachably provided at the lower end thereof with a chip 29*a* which is to be press-contacted with the outer peripheral wall of the log 3 at a position immediately before the knife 3.

Figure 7:
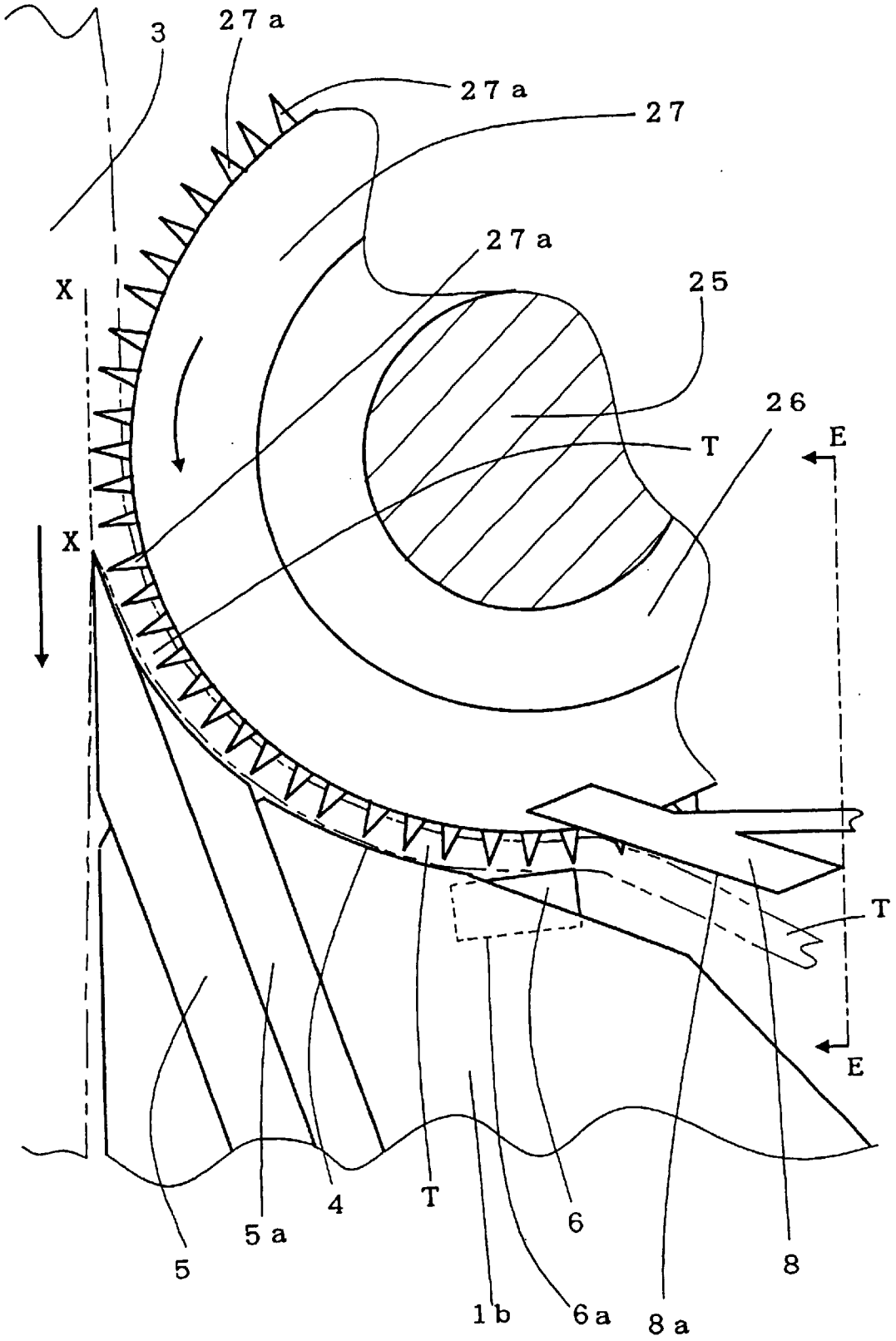
FIG. 7 is an enlarged view illustrating the cutting edge portion of the knife shown in FIG. 3.
Figure 8:
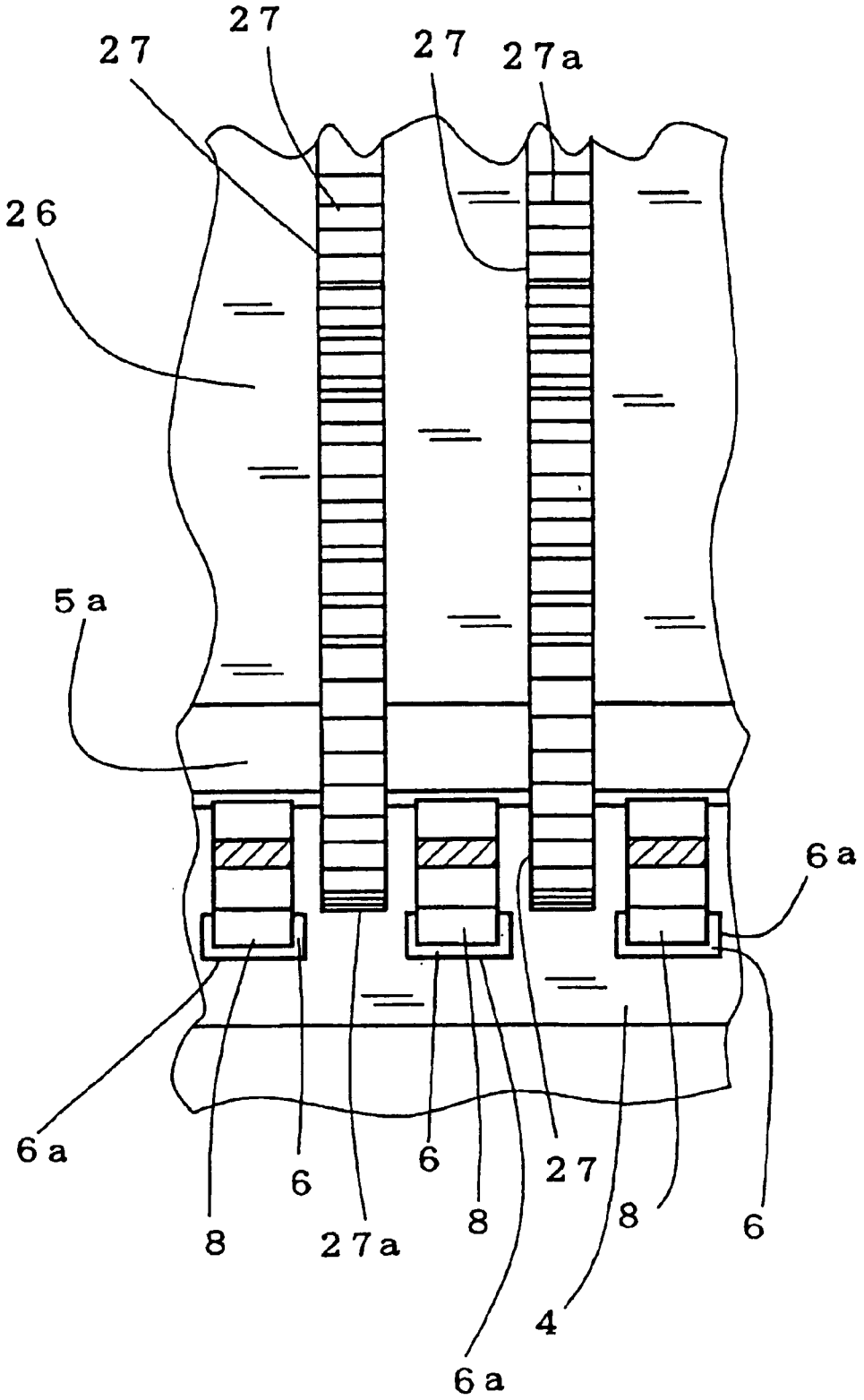
FIG. 8 is a partial cross-sectional view as it is viewed from the direction of arrows of the dot and dash line F—F of FIG. 7.

As shown in FIG. 7 illustrating an enlarged view of the cutting edge portion of the knife 5 shown in FIG. 3 and also shown in FIG. 8 illustrating a partial cross-sectional view of the cutting edge portion as it is viewed from the direction of arrows of the dot and dash line F—F of FIG. 7, a stripping member 8 having a stripping face 8*a* which is disposed to intersect with an imaginary circle interconnecting the tip ends of the piercing projections 27*a* is attached at each interspace between neighboring piercing rolls 27 of the nose bar table 1*a*. By the way, the nose bar 29 is omitted in FIG. 7 for the convenience of explanation.

As shown in FIG. 5, a sprocket 33 is secured to one end portion of the third rotational shaft 25, and a chain 37 for transmitting the motive power of the motor 35 mounted on the nose bar table 1*a* to the sprocket 33 is disposed therebetween while being engaged with the sprocket 36 which is secured to the rotational axis of the motor 35, with a driven sprocket 39 which is mounted, through each bearing member, on the small diametral portion 9*a* and the mount 10, and with a driven sprocket 41. The sprocket 36 of the motor 35 is ordinary rotated in the direction indicated by the arrow, thereby causing the sprocket 33 to rotate in the direction indicated by the arrow. As a result, the piercing rolls 27 are caused to rotate ordinary in the direction indicated by the arrow in FIG. 7.

In order to enable the piercing rolls 27 to reciprocatively move in the direction to contact with or separated away from a portion of the log 3 disposed in the vicinity of the cutting edge of the knife 5, the roller is constructed as follows.

Namely, as shown in FIG. 4, a coupling member 19*a* is attached to one side of the arm 19 which is opposite to the side facing the knife 5. Further, an air cylinder 43 is rotatably mounted through the terminal end portion thereof on a portion of the nose bar table 1*a*, and a flange 43*b* having a larger diameter than that of the piston rod 43*a* is attached to the distal end portion of the piston rod 43*a* which is made retractable, wherein the coupling member 19*a* and the flange 43*b* are rotatably interconnected with each other by means of a pin 44.

By the way, the air cylinder 43 is attached to the nose bar table 1*a* in such a manner that when the piston rod 43*a* is advanced fully from the main body of the air cylinder 43, the tip ends of the piercing projections 27*a* of the piercing rolls 27 mounted on the fourth rotational shaft 26, which are located close to the log 3, are enabled to take a first position which coincides with an imaginary cut line which is assumed to be cut by the knife 5, i.e. the two dots and dash line X—X which is extended perpendicularly upward from the cutting edge of the knife 5 as shown in FIG. 7.

Additionally, a cylindrical stopper 46 into which the piston rod 43*a* is enabled to be inserted is provided, so that when the piston rod 43*a* is moved back to the main body of the air cylinder 43, the flange 43*b* is caused to contact with the stopper 46, whereby the positioning of the piston rod 43*a* is effected by this stopper 46. As a result, the piercing rolls 27 are enabled to be stopped and kept on standby at the second position which is shifted 10 mm rightward from the first position as shown in FIG. 4.

On the other hand, as shown in FIG. 3, the knife 5 for cutting the log 3 which is rotatably supported by the spindle 2 (the rotation of the log 3 is effected by means of the motor 2*a* shown in FIG. 1) is mounted on a knife holder table 1*b* (which constitutes a lower portion of the knife carriage 1) in such a manner that as in the case of the conventional veneer lathe, the knife 5 is sustained by a 5*a*, etc. with the cutting edge thereof being directed upward.

As shown in FIG. 7, a concave portion 4 is formed on the surface of the knife holder table 1*b* facing the piercing rolls 27, and a guide member 6 is inserted into and fixed to a cut-out portion 6*a* which is formed on a surface portion of the knife holder table 1*b* facing the piercing rolls 27. Specifically, the guide member 6 is disposed in such a manner that a portion thereof is protruded upward from the cut-out portion 6*a* and is positioned to face the stripping member 8. Namely, these concave portion 4 and guide member 6 constitute together with the backing plate 5*a* one example of guiding member.

By the way, when the piercing rolls 27 are placed at the lowest level in the elevational direction thereof and at the same time, at the first position in the horizontal direction thereof, each surface of the backing plate 5*a*, concave portion 4 and the guiding member 6, which faces the piercing rolls 27, is designed to constitute a portion of concentric circle of the piercing rolls 27 with a distance between said each surface and the tip ends of the piercing projections 27*a* being set to about 2 mm.

Further, as shown in FIG. 2, when the connecting member 1*d* attached to the nose bar table 1*a* and the connecting member 1*c* attached to the knife holding table 1*b* are connected with each other through a connecting body 1*e*, these tables 1*a* and 1*b* can be integrated, thus forming a knife carriage 1.

By the way, although the right side portion of the roller is shown in FIG. 2 illustrating the front view of the knife carriage 1, the left side portion of the roller is symmetrical to the right side portion of the roller is shown in FIG. 2, so that components of the same kinds as shown in FIG. 2 are disposed therein.

When, for instance, the piercing rolls 27 are placed at the highest level in the elevational direction thereof and at the same time, at the second position in the horizontal direction thereof in the structure of roller shown in FIG. 7, the servo-motor 14 is actuated at first so as to rotate the first rotational shaft 9, thereby rendering the piercing rolls 27 to take and keep a state as shown in FIG. 3 or a state where the piercing rolls 27 are positioned at the lowest level, and at the same time, in order to keep the piercing rolls 27 in a state of standby at the first position, the piston rod 43*a* of the air cylinder 43 is advanced toward the log 3 to thereby perform the initialization.

As a result, the piercing rolls 27 are kept on standby at the position shown in FIG. 7, and hence, the distance between the tip ends of the piercing projections 27*a* of the piercing rolls 27 and the backing plate 5*a*, concave portion 4 and the guiding member 6, which faces the piercing rolls 27, can be set to about 2 mm.

Under these conditions, the piercing rolls 27 are rotated in the direction indicated by the arrow by means of motor 35, and at the same time, the knife carriage 1 is shifted toward the log 3 at a rate of 3.5 mm per revolution of the log 3, the rotation of the log 3 being effected by means of the spindle 2 while controlling a synchronization mechanism (not shown) so as to make the peripheral speed of the log 3 coincide all the time with the peripheral speed of the piercing rolls 27.

Figure 13:
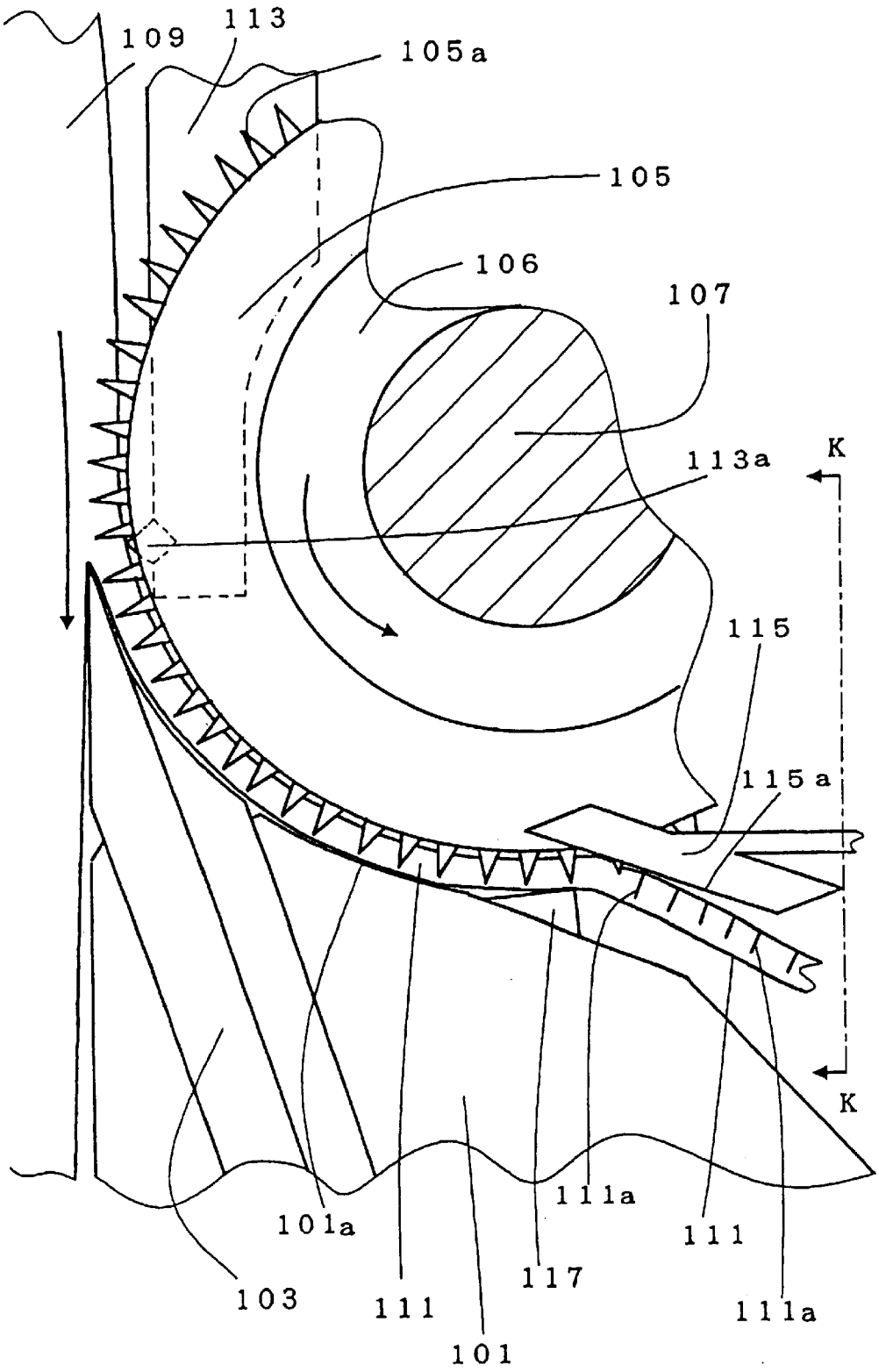
FIG.13 PRIOR ART
FIG. 13 is an enlarged sectional view illustrating a conventional apparatus.

As a result, in the same manner as in the case of the conventional apparatus of FIG. 13, the outer peripheral wall of the log 3 as indicated by a two dots and dash line is permitted to be pierced by the piercing projections 27*a* of the piercing rolls 27 as shown in FIG. 7, thereby giving a rotational force to the log 3 also from the piercing rolls 105 and allowing the log 3 to be cut by the knife 5 with the peripheral surface of the log 3 being pressed by the chip 29*a* of nose bar 29, thus obtaining the veneer T having a thickness of 3.5 mm for instance.

Since the distance between the tip ends of the piercing projections 27*a* of the piercing rolls 27 and the surfaces of backing plate 5*a*, concave portion 4 and guiding member 6 is set as mentioned above, the veneer T is kept pierced by the piercing projections 27*a* due to its own weight, etc. and allowed to pass through the portions of backing plate 5*a*, concave portion 4 and guiding member 6 until the veneer T is contacted with the stripping member 8, at which point the veneer T is removed from the piercing projections 27*a* and transferred to the next step.

The veneer T thus obtained is accompanied with a large number of pierced scars due to the piercing by the piercing projections 27*a* of the piercing rolls 27.

Next, the production of a veneer which is desirably free from any external scars such as pierced scars as in the case of the veneer to be employed as a front sheet for constituting an outermost layer of laminate body such as plywood will be explained.

Figure 9:
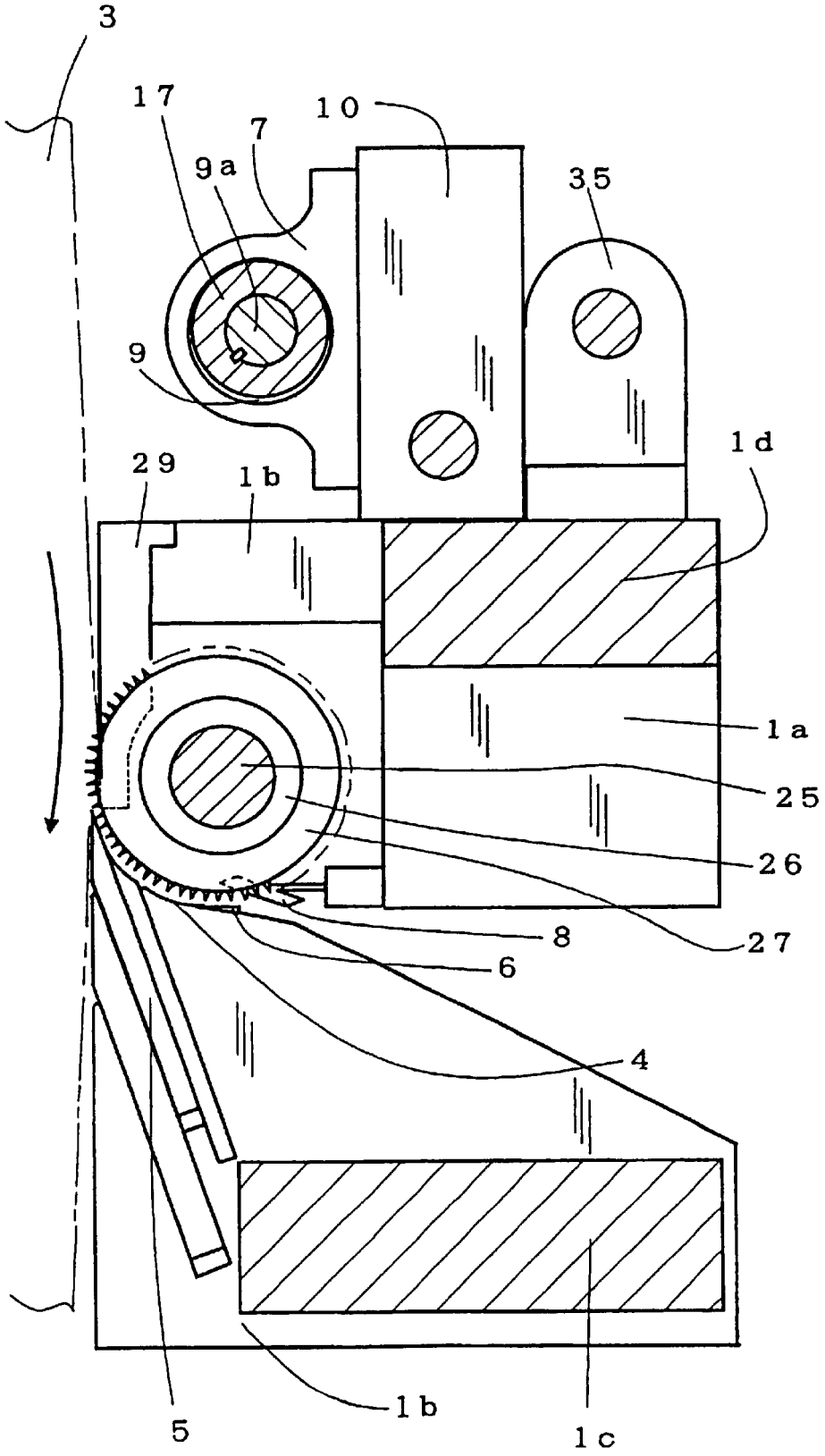
FIG. 9 is an enlarged side view illustrating the operation according one embodiment of the present invention.

In this case, in relative to the positions of the members shown in FIG. 7, the motor 14 is rotated at first, i.e. before starting the cutting operation, thereby causing the first rotational shaft 9 to turn 180 degrees. As a result, the position of the second rotational shaft 17 relative to the first rotational shaft 9 is changed from the state shown in FIG. 3 to the state shown in FIG. 9. Namely, the arm 19 supported by the second rotational shaft 17 is caused to be raised as a whole by a height of 2 mm and at the same time, the piercing rolls 27 fixed to the fourth rotational shaft 26 is also caused to be raised by a height of 2 mm, thus keeping them in a state of standby at the highest position thereof.

Then, the piston rod 43*a* of the air cylinder 43 is moved backward so as to enable the coupling member 43*b* to press-contact with the stopper 46, thereby shifting the piercing rolls 27 from the first position to the second position where the piercing rolls 27 are kept on standby.

Figure 10:
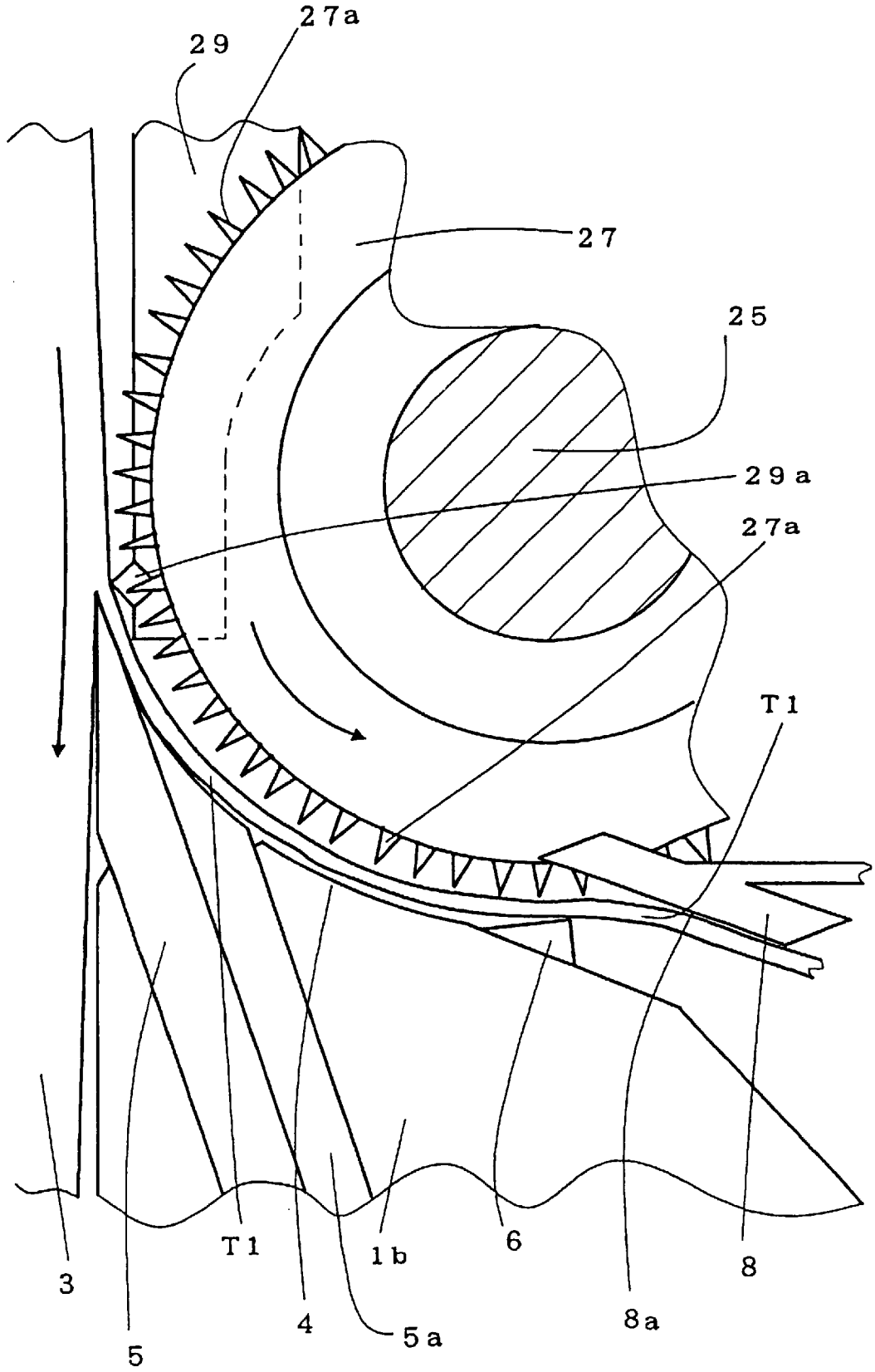
FIG. 10 is an enlarged side view illustrating the operation according another embodiment of the present invention.

As a result, the relationship between the piercing rolls 27 and other members would become as shown in FIG. 10 showing an enlarged view of FIG. 7. Namely, the piercing projections 27*a* are kept away from the log 3 and the distance between the tip ends of the piercing projections 27*a* of the piercing rolls 27 and the surfaces of concave portion 4 and guiding member 6 becomes about 2 mm.

By the way, the nose bar 29 and the chip 29*a* are shown in FIG. 10.

Under this condition, in the same manner as described above, the piercing rolls 27 are rotated in the direction indicated by the arrow, and at the same time, the knife carriage 1 is shifted toward the log 3 at a rate of 1 mm per revolution of the log 3, the rotation of the log 3 being effected by means of the spindle 2 while controlling the spindle 2 so as to make the peripheral speed of the log 3 coincide all the time with the peripheral speed of the piercing rolls 27.

As a result, as shown in FIG. 10, the outer peripheral wall of the log 3 is prevented from being pierced by the piercing projections 27*a* of the piercing rolls 27, thereby receiving the rotational force from only the spindle 2 and allowing the log 3 to be cut by the knife 5 with the peripheral surface of the log 3 being pressed by the chip 29*a* of nose bar 29, thus obtaining the veneer T1 having a thickness of 1 mm for instance.

The veneer T1 is then allowed to pass through spaces between the tip ends of the piercing projections 27*a* of the piercing rolls 27 and the surfaces of concave portion 4 and guiding member 6, and after being contacted with the stripping member 8, the veneer T1 is transferred to the next step. Since the distance between the tip ends of the piercing projections 27*a* of the piercing rolls 27 and the surfaces of backing plate 5*a*, concave portion 4 and guiding member 6 is set to about 2 mm during the transfer of this veneer T1, the veneer T1 is prevented from being pierced by the piercing projections 27*a* during the passage thereof through these spaces, thus making it possible to obtain the veneer T1 free from any pierced scars.

In the case of producing the veneer T1 which is free from any pierced scars, the veneer T1 can be produced without necessitating the rotation of the piercing rolls 27. However, the rotation of the piercing rolls 27 during the production of the veneer T1 would be advantageous due to the following effects.

Generally, the generation of so-called curling phenomenon or a phenomenon of causing the veneer to be rounded into a cylindrical configuration tends to occur in the production of a veneer through the cutting of a log. However, even if this curling phenomenon to round up the lower end portion located downstream side in the transferring direction of the veneer T1 tends to be generated during the transfer thereof until it is contacted with the stripping member 8, the lower end portion of the veneer T1 is permitted to be contacted with the tip ends of the piercing projections 27*a* of the piercing rolls 27 which are being rotated, whereby the lower end portion of the veneer T1 is enabled to be guided toward the stripping member 8. As a result, the veneer T1 is prevented from being clogged at an interface between the piercing rolls 27 and the concave portion 4 or guiding member 6.

Moreover, once the interface between the log 3 and the nose bar 29 is clogged with wood chips (waste), a wedging effect may be generated at the interface, so that a large pushing force is imposed on the log 3, thus giving rise to the generation of a continuous groove-like flaw on the surface of the veneer thus obtained. Even in this case, as long as the piercing rolls 27 is kept rotated, the wood chips existing at the interface can be pierced by the piercing projections 27*a* of the piercing rolls 27 and allowed to pass through a space between the chip 29*a* and the log 3 due to the rotational force of the piercing rolls 27 and to contact with the stripping member 8. As a result, the wood chips can be removed from the piercing projections 27*a*. Furthermore, even if a recessed portion is partially generated on the surface of veneer due to the wood chips during the transfer of the veneer, the recessed portion would not become a continuous flaw.

The production of a veneer which is desirably free from any external scars such as pierced scars as in the case of the veneer to be employed as a front sheet for constituting an outermost layer of laminate body such as plywood may be performed in the following manner.

In this case also, in relative to the positions of the members shown in FIG. 7, the motor 14 is rotated at first, i.e. before starting the cutting operation, thereby causing the first rotational shaft 9 to turn 180 degrees so as to keep the piercing rolls 27 in a state of standby at the highest position thereof. Additionally, the position where the piercing rolls 27 is shifted away from the log and kept on standby through the actuation of the air cylinder 43 is selected to be such as described below.

Figure 11:
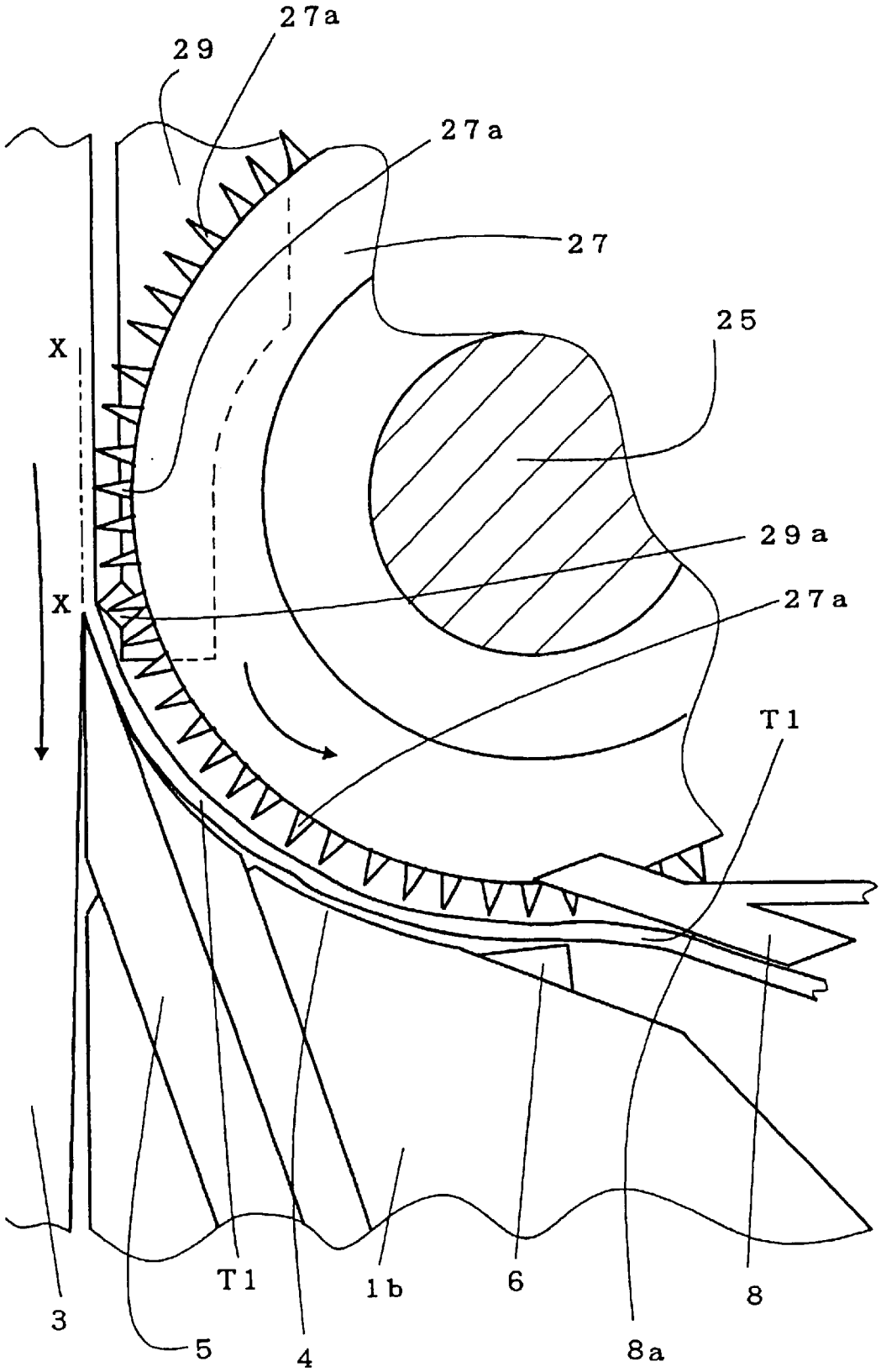
FIG. 11 is an enlarged side view illustrating the operation according another embodiment of the present invention.

Namely, the piercing rolls 27 is kept in a state of standby at the position where the distance between the tip end of the piercing projections 27*a* of piercing rolls 27 which are disposed close to the log 3 and the aforementioned imaginary line X—X would become identical with the thickness of the veneer being cut, e.g. about 1 mm as shown in FIG. 11 at the moment when the flange 43*b* is contacted with the stopper 46 as the piston rod 43*a* is moved backward through the actuation of the air cylinder 43 from the position of the piercing rolls 27 shown in FIG. 7.

For this purpose, the length of the stopper 46 installed as shown in FIG. 4 is extended along the moving direction of the piston rod 43*a*. For example, the interval between the flange 43*b* and the stopper 46 in FIG. 4 is set to about 1 mm.

As described above, the piercing rolls 27 are kept in a state of standby at the uppermost position thereof through the rotation of the motor 14 and then, the distance between the tip end of the piercing projections 27*a* and the imaginary line X—X is set to about 1 mm, after which the piercing rolls 27 are rotated in the direction indicated by the arrow as shown in FIG. 11, and at the same time, the knife carriage 1 is shifted toward the log 3 at a rate of 1 mm per revolution of the log 3, the rotation of the log 3 being effected by means of the spindle 2 while controlling the spindle 2 so as to make the peripheral speed of the log 3 coincide all the time with the peripheral speed of the piercing rolls 27.

As a result, as shown in FIG. 11, the piercing projections 27*a* of the piercing rolls 27 is allowed to rotate at the same speed as that of the log 3 while the piercing projections 27*a* are contacted with the outer peripheral wall of the log 3 being rotated, whereby the force required for the cutting of the log 3 is substantially given by the spindle 2, and the log 3 is cut by the knife 5 with the peripheral surface thereof being always pressed by the chip 29*a* of nose bar 29, thus obtaining the veneer T1 having a thickness of 1 mm for instance.

The surface of veneer T1 thus obtained is substantially free from any pierced flaws, and even if a space between the log 3 and the nose bar 29 is clogged with wood chips as in the aforementioned example, the wood chips would be deeply pierced by the piercing projections 27*a*, thereby making it possible to reliably remove the wood chips after allowing the wood chips to pass through a space between the log 3 and the chip 3*a*.

Where it is desired to cut the log 3 while allowing the log 3 to be pierced by the piercing rolls 27 in the aforementioned example, the outer peripheral wall of the log 3 is enabled to be press-contacted with the piercing rolls 27 through the adjustment of the force of the air cylinder 43, so that the pressure of the piercing rolls 27 to be imposed on the log 3 can be suitably adjusted depending on the magnitude of the hardness of the log 3.

For example, if a hard log is to be treated, the cutting resistance to be imposed on the knife 5 would be increased. In such a case, the pressure of the air cylinder 43 is increased so as to allow the log to be fully pierced by the piercing projections 27*a* of the piercing rolls 27, thus making it possible to increase the driving force to be given to the log 3 from the piercing rolls 27 and hence to perform an excellent cutting. On the other hand, if a relatively soft log is to be treated, the cutting resistance to be imposed on the knife 5 would be small, so that the pressure of the air cylinder 43 is minimized so as to allow the log to be slightly pierced by the piercing projections 27*a* of the piercing rolls 27 in the cutting operation of the log 3.

The aforementioned examples can be modified as follows.

1. The operation of shifting the piercing rolls 27 from the position where the piercing projections 27*a* are pierced into the surface of log 3 as shown in FIG. 7 to the position where the piercing projections 27*a* are kept away from or contacted with the log 3 as shown in FIG. 10 or 11; or on the contrary, the operation of shifting the piercing rolls 27 from the position where the piercing projections 27*a* are kept away from or contacted with the log 3 to the position where the piercing projections 27*a* are pierced into the surface of log 3 may be performed without interrupting the cutting operation of the log 3. Namely, without necessitating the interruption of the rotation of the log 3, i.e. the interruption of the revolution of the log 3, the magnitude of shifting the knife carriage 1 per revolution of the log 3 can be changed or the position of the piercing rolls 27 can be changed through the actuation of servo-motor 14 and air cylinder 43.

2. The depth of the piercing projections 27*a* of the piercing rolls 27 in the surface of the log 3 as shown in FIG. 7, as well as the distance to keep the piercing projections 27*a* away from the log 3 as shown in FIG. 10 can be suitably selected.

3. In addition to the position where the piston rod 43*a* is fully advanced from the main body of the cylinder 43 and to the position where the piston rod 43*a* is retracted back into the main body of the cylinder 43, the air cylinder 43 may be enabled to stop at a desired intermediate position between the aforementioned positions through the application of a braking action to the piston rod 43*a*, thus modifying the air cylinder 43 into an air cylinder provided with an intermediate stopping mechanism, which can be employed as follows.

Namely, the piercing rolls 27 are enabled to take and keep a position where the piston rod 43*a* of the air cylinder is fully advanced thereby enabling the piercing projections 27*a* to pierce into the log 3 as shown in FIG. 7; a position where the piston rod 43*a* is slightly retracted through the action of brake, thereby enabling the piercing projections 27*a* to contact with the log 3 as shown in FIG. 11; or a position where the piston rod 43*a* is retracted through the release of brake, thereby enabling the flange 43*b* to be contacted with the cylindrical stopper 46 so as to keep the piercing projections 27*a* away from the log 3 as shown in FIG. 10.

4. As for the first reciprocating member for enabling the piercing projections 27*a* of piercing rolls 27 to take a position permitting them to pierce the outer periphery of log 3 or to take a position where the piercing projections are contacted with or kept away from the outer periphery of log 3, and as for the second reciprocating member for enabling the piercing rolls 27 to move so as to change the distance between the tip end of the piercing projections 27*a* and the guiding member such as the concave portion or the guiding portion, these reciprocating members may be formed by making use of a cam.

5. In the aforementioned examples, the guiding member for guiding a veneer that has been cut by means of a knife so as to move it along the driving members is constituted as one example by three components comprising the backing plate 5*a*, the concave portion 4 and the guiding member 6. However, the guiding member may be constituted by a single component or a suitable number of components.

6. The cutting operation of the log 3 while allowing the outer peripheral wall of log 3 to be pierced by the piercing projections of the piercing rolls 27 as shown in FIG. 7 may be performed in the following manner.

Figure 12:
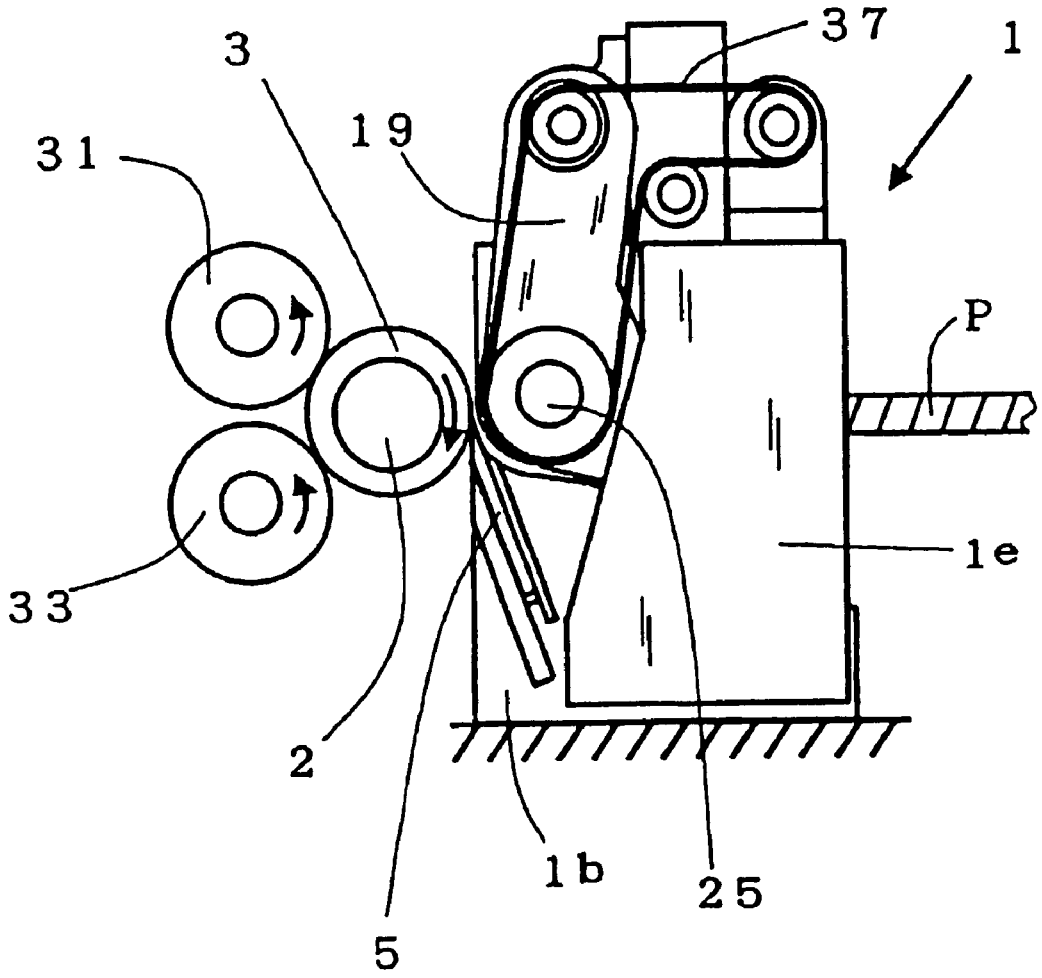
FIG. 12 is a side view schematically showing a modified example of a veneer lathe according to the present invention.

Namely, as shown in FIG. 12, a pair of driven rollers 31 and 33 disposed parallel and respectively having a rotational center which is located (spaced apart from each other by a predetermined distance) along the vertical direction orthogonally intersecting a horizontal imaginary line passing through the rotational center of the spindle 2 are disposed on the side of the log 3 which is opposite to where the knife carriage 1 is positioned. More specifically, these driven rollers 31 and 33 are contacted with the outer peripheral wall of the log and designed to be horizontally moved toward the spindle 2 at the same shifting rate as that of the knife carriage 1 during the cutting operation of the log 3. In this construction, even if the spindle 2 is moved away from the log 3 after these rollers 31 and 33 are contacted with the outer peripheral wall of the log, the log 3 can be kept sustained by these rollers 31 and 33, and at the same time, the driving power required for the cutting can be supplied from only the piercing rolls 27, so that the log 3 can be cut even after the diameter of the log 3 has become smaller than that of the spindle 2.

In this case, with a view to supplement the driving force required for the cutting of the log 3, at least one of these rollers 31 and 33 may be constituted by a driving roller.

7. The stripping member 8 may be also provided with a shifting member for allowing the stripping member 8 to reciprocatively move in the direction orthogonally intersecting the running direction of the log 3 in the vicinity of the cutting edge of the knife 5.

According to the veneer lathe of the present invention which is provided, on the knife carriage, with driving members each having piercing projections such as piercing rolls, and with a guiding member such as a concave portion or a guiding portion for enabling a veneer to move along the driving members, since at least a portion of the driving force required for the cutting of the log can be supplied through the piercing of the piercing projections into the surface of the log, a veneer which is free or substantially free from piercing flaws can be produced.

What is claimed is:

1. A veneer lathe which comprises;

a knife for cutting a log;

a roller disposed substantially parallel with the linear cutting edge of the knife and provided with a large number of driving members which are arranged at intervals along the axial direction of the roller, each driving member being provided along the circumference thereof with a large number of piercing projections;

a driving mechanism attached to the roller;

a pressure member disposed at a location which enables the pressure member to press-contact with the outer peripheral wall of the log through a plurality of spaces formed between said driving members neighboring to each other of the roller;

a guiding member for guiding a veneer which is cut by means of said knife to move along said driving members;

a knife carriage for mounting thereon said knife, said roller, said driving mechanism, said pressure member and said guiding member;

a spindle rotatably supporting a log; and a driving for rotating said spindle;

wherein said roller is enabled to take a first position wherein said piercing projections of the driving member is enabled to pierce not only the outer peripheral wall portion of a log in the vicinity of said cutting edge of said knife but also a portion of the veneer which is cut by said cutting knife and is not yet passed through said guiding member, as well as to take a second position wherein said piercing projections of the driving member is not allowed to contact with not only the outer peripheral wall portion of the log but also said portion of the veneer or wherein the tip ends of said piercing projections are contacted only with the outer peripheral wall portion of the log in the vicinity of said cutting edge, said rollers being designed to be fixed at said first position or at said second position.

2. The veneer lathe according to claim 1, wherein the movement of said roller from the first position to the second position and vice versa, and the fixing of said roller at these positions are effected;

by a first reciprocating member mounted on the knife carriage for enabling the roller to be reciprocatively moved to take a position permitting the piercing projections to pierce the outer periphery of log in the vicinity of the cutting edge of the knife and to take a position where the piercing projections are kept away from the outer periphery of log; and by a second reciprocating member mounted on the knife carriage for enabling the roller to be reciprocatively moved to take a position where a distance between the tip end of the piercing projections and the guiding member located in the vicinity of the cutting edge of the knife and in the running direction of the log is smaller than the thickness of the veneer being cut, and to take a position where said distance is larger than the thickness of the veneer being cut.

3. The veneer lathe according to claim 1, wherein the movement of said roller from the first position to the second position and vice versa, and the fixing of said roller at these positions are effected;

by a first reciprocating member mounted on the knife carriage for enabling the roller to be reciprocatively moved to take a position permitting the piercing projections to pierce the outer periphery of log in the vicinity of the cutting edge of the knife and to take a position where the tip ends of piercing projections are allowed to contact with the outer periphery of log in the vicinity of the cutting edge; and by a second reciprocating member mounted on the knife carriage for enabling the roller to be reciprocatively moved to take a position where a distance between the tip end of the piercing projections and the guiding member located in the vicinity of the cutting edge of the knife and in the running direction of the log is smaller than the thickness of the veneer being cut, and to take a position where said distance is larger than the thickness of the veneer being cut.

4. The veneer lathe according to claim 2 or 3, wherein said first reciprocating member is formed of an air cylinder.

5. The veneer lathe according to claim 2 or 3, wherein said second reciprocating member comprises an eccentric cam, wherein said roller is rotatably secured to a lower end portion of an arm which is enabled to be moved to take, through the rotation of this eccentric cam, a position which is close to the guiding member or a position which is away from the guiding member.

6. The veneer lathe according to claim 1, wherein the movement of said roller from the first position to the second position and vice versa, and the fixing of said roller at these positions are effected;

by a first reciprocating member mounted on the knife carriage for enabling the roller to be reciprocatively moved to take a position permitting the piercing projections to pierce the outer periphery of log in the vicinity of the cutting edge of the knife, to take a position where the tip ends of piercing projections are allowed to contact with the outer periphery of log in the vicinity of the cutting edge, and to take a position where the piercing projections are kept away from the outer periphery of log; and by a second reciprocating member mounted on the knife carriage for enabling the roller to be reciprocatively moved to take a position where a distance between the tip end of the piercing projections and the guiding member located in the vicinity of the cutting edge of the knife and in the running direction of the log is smaller than the thickness of the veneer being cut, and to take a position where said distance is larger than the thickness of the veneer being cut.

7. The veneer lathe according to claim 6, wherein said first reciprocating member is constituted by an air cylinder provided with an intermediate stopping mechanism.

8. The veneer lathe according to claim 7, wherein said second reciprocating member comprises an eccentric cam, wherein said roller is rotatably secured to a lower end portion of an arm which is enabled to be moved to take, through the rotation of this eccentric cam, a position which is close to the guiding member or a position which is away from the guiding member.

* * * * *

US006357496C1

(12) EX PARTE REEXAMINATION CERTIFICATE (5768th)

United States Patent
Koike

(10) Number: US 6,357,496 C1
(45) Certificate Issued: May 22, 2007

(54) VENEER LATHE

(75) Inventor: Masaru Koike, Aichi (JP)

(73) Assignee: Meinan Machinery Works, Inc., Obu (JP)

Reexamination Request:
No. 90/007,044, May 20, 2004

Reexamination Certificate for:

| | |
|---|---|
| Patent No.: | **6,357,496** |
| Issued: | **Mar. 19, 2002** |
| Appl. No.: | **09/635,665** |
| Filed: | **Aug. 10, 2000** |

(30) Foreign Application Priority Data

Aug. 12, 1999 (JP) ..... 11-228853
May 25, 2000 (JP) ..... 2000-159557

(51) Int. Cl.
*B27L 5/02* (2006.01)

(52) U.S. Cl. ..... 144/213; 144/209.1; 144/365

(58) Field of Classification Search ..... None
See application file for complete search history.

(56) References Cited

FOREIGN PATENT DOCUMENTS

JP 62-161505 7/1787

*Primary Examiner*—Beverly M. Flanagan

(57) ABSTRACT

A veneer lathe comprising a piercing roller and a guiding member for producing a veneer which is free from piercing scars. A third rotational shaft (25) is raised from the position where the piercing projections (27a) of the piercing rolls (27) are pierced into the outer peripheral wall of the log (3) to a position which enables the distance between the tip end of the piercing projections (27a) and the backing plate (5a), the concave portion (4) and the guide member (6) to become larger than the thickness of the veneer (T1), and then, the third rotational shaft (25) is moved away from the log (3) up to a position which makes the piercing projections (27a) impossible to pierce the outer perpheral wall of the log (3), after which the log (3) is rotated to perform the cutting by means of knife (5).

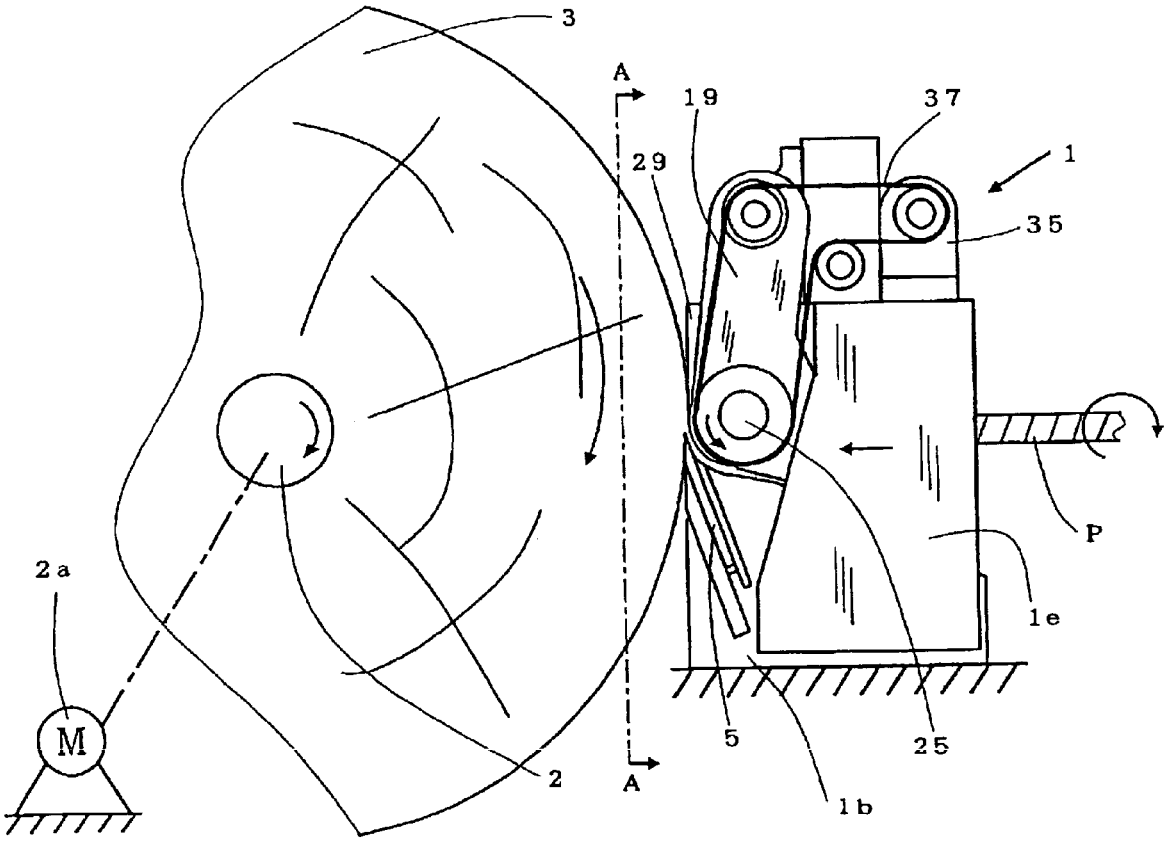

FIG. 7 (AMENDED)
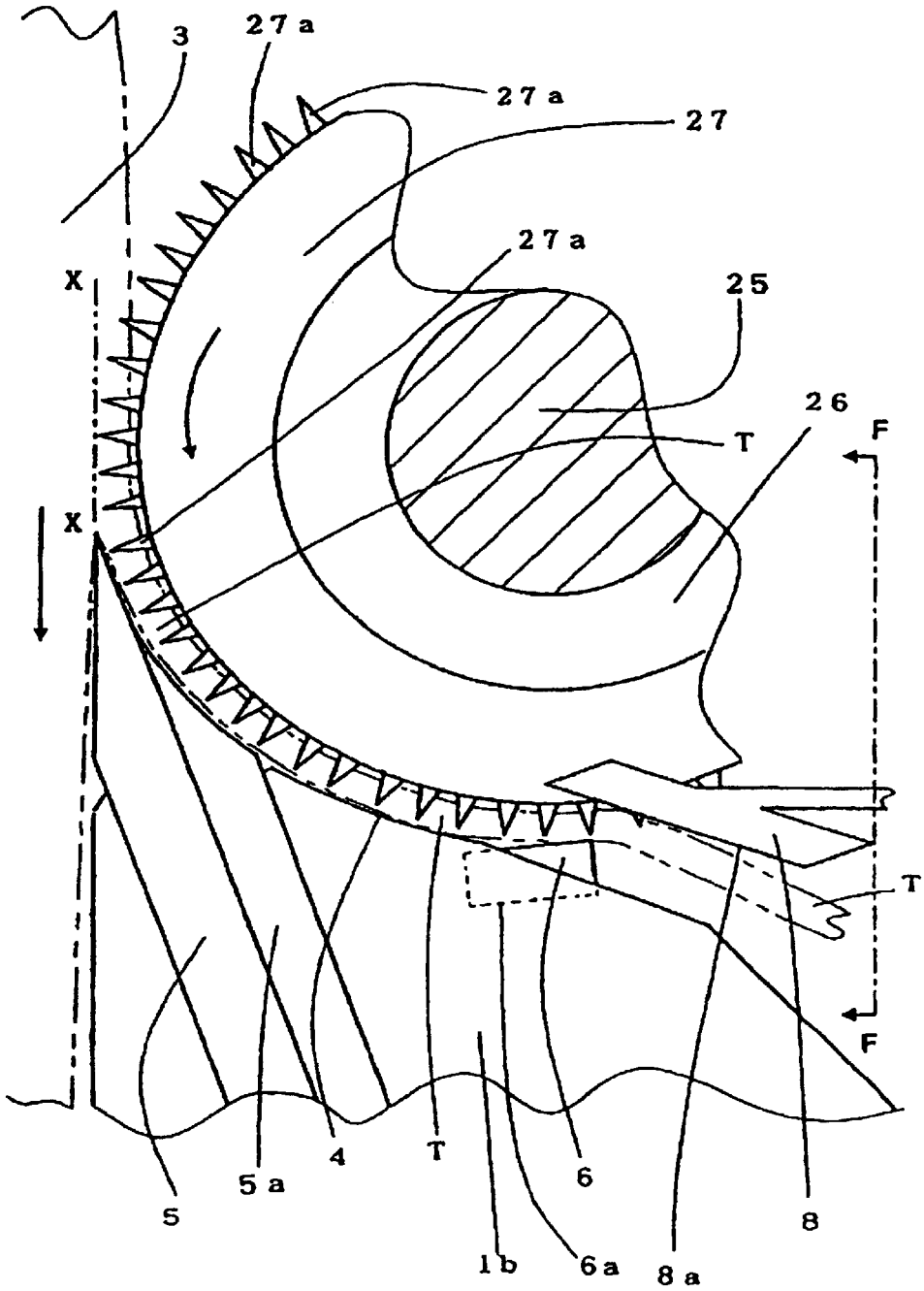

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 5, lines 1–15:

FIG. 1 shows a side view schematically illustrating the knife carriage 1 (*referenced also as veneer lathe 1 below*) and spindle 2 of a veneer lathe; FIG. 2 shows a partial front view of the right side of the knife carriage 1 which is viewed from the direction of arrows of the dot and dash line A—A of FIG. 1 wherein a log 3 of FIG. 1 is omitted for the convenience of explanation; FIG. 3 shows a partial cross-sectional view as it is viewed from the direction of arrows of the dot and dash line B—B of FIG. 2; FIG. 4 shows a partial cross-sectional view as it is viewed from the direction of arrows of the dot and dash line C—C of FIG. 2; FIG. 5 shows a partial cross-sectional view as it is viewed from the direction of arrows of the dot and dash line D—D of FIG. 2; and FIG. 6 shows a partial cross-sectional view as it is viewed from the direction of arrows of the dot and dash line E—E of FIG. 2.

Column 5, lines 60–64:

As shown in FIG. [14] *4*, an upper end portion of arm 19 is sustained through a first bearing 21 to the second rotational axis 17, so that the arm 19 is permitted to rotate [in] relative to the second rotational axis 17.

Column 6, lines 24–33:

Between each pair of the piercing rolls 27 neighboring to each other in the axial direction of the fourth rotational axis 26, there is interposed, as shown in FIG. 3, a nose bar 29 representing one example of the pressure member with the upper end portion of the nose bar 29 being fixed to the nose bar table 1a. By the way, as explained hereinafter, the nose bar 29 is detachably provided at the lower end thereof with a chip 29a which is to be press-contacted with the outer peripheral wall of the log 3 at a position immediately before the knife [3] *5*.

Column 6, lines 45–58:

As shown in FIG. 5, a sprocket 33 is secured to one end portion of the third rotational shaft 25, and a chain 37 for transmitting the motive power of the motor 35 mounted on the nose bar table 1a to the sprocket 33 is disposed therebeteeen while being engaged with the sprocket 36 which is secured to the rotational axis of the motor 35, with a driven sprocket 39 which is mounted, through each bearing member, on the small diametral portion 9a and the mount 10, and with a driven sprocket 41. The sprocket 36 of the motor 35 is [ordinary] *ordinarily* rotated in the direction indicated by the arrow, thereby causing the sprocket 33 to rotate in the direction indicated by the arrow. As a result, the piercing rolls 27 are caused to rotate ordinary in the direction indicated by the arrow in FIG. 7.

Column 6, lines 59–62:

In order to enable the piercing rolls 27 to reciprocatively move in the direction to contact [with] or [separated away] *to separate* from a portion of the log 3 disposed in the vicinity of the cutting edge of the knife 5, the roller is constructed as follows.

Column 10, lines 65–66 to column 11, lines 1–6:

The surface of veneer T1 thus obtained is substantially free from any pierced flaws, and even if a space between the log 3 and the nose bar 29 is clogged with wood chips as in the aforementioned example, the wood chips would be deeply pierced by the piercing projections 27a, thereby making it possible to reliably remove the wood chips after allowing the wood chips to pass through a space between the log 3 and the chip [3a] *29a*.

THE DRAWING FIGURES HAVE BEEN CHANGED AS FOLLOWS:

Line E—E has been changed to F—F.

AS A RESULT OF REEXAMINATION, IT HAS BEEN DETERMINED THAT:

Claim 1 is cancelled.

Claims 2, 3 and 6 are determined to be patentable as amended.

Claims 4, 5, 7 and 8, dependent on an amended claim, are determined to be patentable.

2. [The] *A* veneer lathe [according to claim 1] *which comprises:*

*a knife for cutting a log;*

*a roller disposed substantially parallel with the linear cutting edge of the knife and provided with a large number of driving members which are arranged at intervals along the axial direction of the roller, each driving member being provided along the circumference thereof with a large number of piercing projections;*

*a driving mechanism attached to the roller;*

*a pressure member disposed at a location which enables the pressure member to press-contact with the outer peripheral wall of the log through a plurality of spaces formed between said driving members neighboring to each other of the roller;*

*a guiding member for guiding a veneer which is cut by means of said knife to move along said driving members;*

*a knife carriage for mounting thereon said knife, said roller, said driving mechanism, said pressure member and said guiding member;*

*a spindle rotatably supporting a log; and*

*a driver for rotating said spindle;*

*wherein said roller is enabled to take a first position wherein said piercing projections of the driving member is enabled to pierce not only the outer peripheral wall portion of a log in the vicinity of said cutting edge of said knife but also a portion of the veneer which is cut by said cutting knife and is not yet passed through said guiding member, as well as to take a second position wherein said piercing projections of the driving member is not allowed to contact with not only the outer peripheral wall portion of the log but also said*

*portion of the veneer or wherein the tip ends of said piercing projections are contacted only with the outer peripheral wall portion of the log in the vicinity of said cutting edge, said rollers being designed to be fixed at said first position or at said second position,* wherein the movement of said roller from the first position to the second position and vice versa, and the fixing of said roller at these positions are effected[;]:

by a first reciprocating member mounted on the knife carriage for enabling the roller to be reciprocatively moved to take a position permitting the piercing projections to pierce the outer periphery of log in the vicinity of the cutting edge of the knife and to take a position where the piercing projections are kept away from the outer periphery of log; and by a second reciprocating member mounted on the knife carriage for enabling the roller to be reciprocatively moved to take a position where a distance between the tip end of the piercing projections and the guiding member located in the vicinity of the cutting edge of the knife and in the running direction of the log is smaller than the thickness of the veneer being cut, and to take a position where said distance is larger than the thickness of the veneer being cut.

3. [The] *A* veneer lathe [according to claim 1] *which comprises:*

*a knife for cutting a log;*

*a roller disposed substantially parallel with the linear cutting edge of the knife and provided with a large number of driving members which are arranged at intervals along the axial direction of the roller, each driving member being provided along the circumference thereof with a large number of piercing projections;*

*a driving mechanism attached to the roller;*

*a pressure member disposed at a location which enables the pressure member to press-contact with the outer peripheral wall of the log through a plurality of spaces formed between said driving members neighboring to each other of the roller;*

*a guiding member for guiding a veneer which is cut by means of said knife to move along said driving members;*

*a knife carriage for mounting thereon said knife, said roller, said driving mechanism, said pressure member and said guiding member;*

*a spindle rotatably supporting a log; and*

*a driver for rotating said spindle;*

*wherein said roller is enabled to take a first position wherein said piercing projections of the driving member is enabled to pierce not only the outer peripheral wall portion of a log in the vicinity of said cutting edge of said knife but also a portion of the veneer which is cut by said cutting knife and is not yet passed through said guiding member, as well as to take a second position wherein said piercing projections of the driving member is not allowed to contact with not only the outer peripheral wall portion of the log but also said portion of the veneer or wherein the tip ends of said piercing projections are contacted only with the outer peripheral wall portion of the log in the vicinity of said cutting edge, said rollers being designed to be fixed at said first position or at said second position,* wherein the movement of said roller from the first position to the second position and vice versa, and the fixing of said roller at these positions are effected[;]:

by a first reciprocating member mounted on the knife carriage for enabling the roller to be reciprocatively moved to take a position permitting the piercing projections to pierce the outer periphery of log in the vicinity of the cutting edge of the knife and to take a position where the tip ends of piercing projections are allowed to contact with the outer periphery of *the* log in the vicinity of the cutting edge; and by a second reciprocating member mounted on the knife carriage for enabling the roller to be reciprocatively moved to take a position where a distance between the tip end of the piercing projections and the guiding member located in the vicinity of the cutting edge of the knife and in the running direction of the log is smaller than the thickness of the veneer being cut, and to take a position where said distance is larger than the thickness of the veneer being cut.

6. [The] *A* veneer lathe [according to claim 1] *which comprises:*

*a knife for cutting a log;*

*a roller disposed substantially parallel with the linear cutting edge of the knife and provided with a large number of driving members which are arranged at intervals along the axial direction of the roller, each driving member being provided along the circumference thereof with a large number of piercing projections;*

*a driving mechanism attached to the roller;*

*a pressure member disposed at a location which enables the pressure member to press-contact with the outer peripheral wall of the log through a plurality of spaces formed between said driving members neighboring to each other of the roller;*

*a guiding member for guiding a veneer which is cut by means of said knife to move along said driving members;*

*a knife carriage for mounting thereon said knife, said roller, said driving mechanism, said pressure member and said guiding member;*

*a spindle rotatably supporting a log; and*

*a driver for rotating said spindle;*

*wherein said roller is enabled to take a first position wherein said piercing projections of the driving member is enabled to pierce not only the outer peripheral wall portion of a log in the vicinity of said cutting edge of said knife but also a portion of the veneer which is cut by said cutting knife and is not yet passed through said guiding member, as well as to take a second position wherein said piercing projections of the driving member is not allowed to contact with not only the outer peripheral wall portion of the log but also said portion of the veneer or wherein the tip ends of said piercing projections are contacted only with the outer peripheral wall portion of the log in the vicinity of said cutting edge, said rollers being designed to be fixed at said first position or at said second position,* wherein the movement of said roller from the first position to the second position and vice versa, and the fixing of said roller at these positions are effected[;]:

by a first reciprocating member mounted on the knife carriage for enabling the roller to be reciprocatively moved to take a position permitting the piercing projections to pierce the outer periphery of log in the vicinity of the cutting edge of the knife, to take a position where the tip ends of piercing projections are allowed to contact with the outer periphery of log in the vicinity of the cutting edge, and to take a position where the piercing projections are kept away from the outer periphery of log; and by a second reciprocating member mounted on the knife carriage for enabling the roller to be reciprocatively moved to take a position where a distance between the tip end of the piercing projections and the guiding member located in the vicinity of the cutting edge of the knife and in the running direction of the log is smaller than the thickness of the veneer being cut, and to take a position where said distance is larger than the thickness of the veneer being cut.

* * * * *